US007468478B2

(12) United States Patent
Davis

(10) Patent No.: US 7,468,478 B2
(45) Date of Patent: Dec. 23, 2008

(54) GUITAR PLAYING ASSIST APPARATUS

(76) Inventor: Barry Mark Davis, 8142 E. Lake Cypress Dr., Perkinston, MS (US) 39573

( * ) Notice: Subject to any disclaimer, the term of this patent is extended or adjusted under 35 U.S.C. 154(b) by 376 days.

(21) Appl. No.: 10/916,575

(22) Filed: Aug. 12, 2004

(65) Prior Publication Data

US 2005/0145089 A1 Jul. 7, 2005

Related U.S. Application Data

(60) Provisional application No. 60/532,740, filed on Dec. 29, 2003.

(51) Int. Cl.
*G10D 3/00* (2006.01)

(52) U.S. Cl. ..... 84/290

(58) Field of Classification Search ..... 84/485 R, 84/485 SR, 478, 477 R, 484
See application file for complete search history.

(56) References Cited

U.S. PATENT DOCUMENTS 1,346,458 A * 7/1920 Lewis ..... 84/285
4,331,059 A * 5/1982 Marabotto ..... 84/317
4,566,365 A * 1/1986 Huston, Jr. ..... 84/317
6,087,568 A * 7/2000 Seal ..... 84/193
6,891,095 B2 * 5/2005 Charters ..... 84/320
2006/0000342 A1 * 1/2006 Haney ..... 84/471 SR

* cited by examiner

*Primary Examiner*—Kimberly Lockett
(74) *Attorney, Agent, or Firm*—John D. Gugliotta

(57) ABSTRACT

A thin flat body of clear plastic with a key pad (20) on the inside back base (12), and a chord scale (22) on the outside front of the base (10). The chord scale is fitted with braille nodules (24) for guiding the proper placement of the fingers on the EZ chord. On the bottom or lower side of the base (10) (12) is a gripping angle (14) for the learning chord device. On the top or upper side, and bottom or lower side of the base (10) (12) are gripping angles (14) (16) for the universal chord device. One EZ chord is a device that when manipulated by a human hand, or an artificial hand, is pressed and positioned onto the guitar neck, fret and strings to form and sound guitar chords and/or notes. The EZ chord devices can be used by mentally, physically, or visually handicapped people as well as non-handicapped people, to play and/or learn to play the guitar.

24 Claims, 6 Drawing Sheets

GUITAR PLAYING ASSIST APPARATUS

CROSS-REFERENCE TO RELATED APPLICATIONS

This application claims the benefit of PPA Ser. No. 60/532,740 (APPL NO.), FILING OR 371 DATE Dec. 29, 2003, FILING FEE REC'D 105, CONFIRMATION NO. 4831, ORIGINAL FILING RECEIPT OC000000012264825, UPDATED FILING RECEIPT OC000000012538530. DISCLOSURE DOCUMENT NO. 552077, FILING DATE Apr. 26, 2004. DISCLOSURE DOCUMENT NO. 552581, FILING DATE May 03, 2004. PTO-1652 (8/99).

FEDERALLY SPONSORED RESEARCH

Not Applicable

SEQUENCE LISTING OR PROGRAM

Not Applicable

BACKGROUND OF THE INVENTION—FIELD OF THE INVENTION

This invention relates to plastic and rubber music chords, specifically to such chords which are used for playing the guitar.

BACKGROUND OF THE INVENTION

Music and department stores commonly supply consumers with books, paper charts and colored sticker tags for people to study, learn and/or play the guitar. Based on a basic search and a general knowledge of what tools are available, music stores and department stores do not provide learning or playing devices which assist the handicapped guitar player.

Originally learning to play the guitar was accomplished by the use of instruction booklets. For the student, this method has made forming and sounding chords with the fingers difficult, while having to read and study the booklet. As for blind people desiring to learn to play the guitar, some instruction books have been made in braille, but there is no general knowledge of any device which aids blind people with the physical placement of the fingers on the guitar neck. With regard to the above statement, there is no general knowledge of any device which aids the same in sounding chords and notes on the actual guitar strings.

There is no general knowledge of any device that aids people with rheumatoid or other forms of arthritis, gout, or other debilitating diseases of the hands or arms, in playing or learning to play the guitar. With regard to the above statement, there is no general knowledge of any device which aids people with amputated fingers or hands in playing or learning to play the guitar. With regard to the above statement, there is no general knowledge of any device which aids mentally impaired people in playing or learning to play the guitar.

The problem of learning to play the guitar has been partially solved with the use of an instructor, but can be expensive. A major deterrent for anyone who is first attempting to learn to play the guitar has been that of finger blisters and muscle aches on the chord hand. A major advantage of the Handi-Guitar "EZ chord" system of learning to play the guitar is that the whole manner of learning to play the guitar is "reversed". With the chord device being a means of instantly, accurately and easily placing the chord hand, the student can quickly advance to the procedures of the pick hand. Usually, it would require months or even years before a student of the guitar could reach a level of manipulating the chord hand, before mastering the pick hand. It is this "reverse method" that may keep more people involved in the learning process when many would normally quit trying to play the guitar.

The primary name for the Handi-Guitar device is the "EZ Chord", but other names could be Magic Chords, Wonder Chords, perfect Chords, Super Chords, EZ Slide Chords ect.

BACKGROUND OF INVENTION—OBJECTS AND ADVANTAGES

Accordingly, several objects and advantages of my invention are:

(a) to enable people who are handicapped, specifically those with amputated hands or fingers, or those with arthritis, or other illnesses or injuries of the hands or fingers, to play or learn to play the guitar. Music and/or department stores generally do not offer any such device which aid people in the above area with this disability.

(b) to enable people who are handicapped, specifically those who are sight impaired, to play and/or learn to play the guitar. Other than music books which are made in braille, music and/or department stores generally do not offer any such device that aid people in the above area with this disability.

(c) to enable those with a mental or a learning disability to play and/or learn to play the guitar. Other than music books made for children, music and/or department stores generally do not offer any such device which aid people in the above area with this disability.

(d) to enable non-handicapped people to play and/or learn to play the guitar. The "EZ Chord" system of learning guitar entails a "reverse process" (described above) for playing and/or learning to play the guitar. The "reverse process" eliminates the "old system" (described above) of sustaining finger blisters and/or muscle aches to the chord hand, before attempting to learn the pick hand.

Other objects and advantages are:

(a) EZ chords are prefabricated to strike every string at the precise distance and placement of the desired chord.

(b) EZ chords produce an expert sound the very first time they are properly used, in some cases, better than that of an experienced guitar player.

(c) exact placement of the key pad onto the guitar neck and frets, in some cases, exceeds the normal capability of the human hand.

(d) EZ chords are made of clear plastic with the (actual size) guitar scale laminated on the face of the device. The chord scale on the face of the device is made in braille to guide the guitar player in the exact finger placement of the chord being utilized. Based on a general search and a basic knowledge of music and department stores, the only chord and finger scales offered to the consumer are paper charts and books.

Further objects and advantages of my invention will become apparent from a consideration of the drawings and ensuing description.

SUMMARY

In accordance with the present invention a Handi-Guitar, "EZ Chord" is a thin flat body of clear plastic with a rubber key pad on the inside back. The inside back is defined as the side that makes contact with the guitar strings. On the outside front is a (actual size) chord scale with braille nodules that mark the exact placement of the fingers on the chord hand.

The outside front is defined as the side that makes contact with the human or artificial hand and fingers. At the bottom of the base is a slightly beveled gripping angle for the learning chords. At the top and bottom of the base are slightly beveled gripping angles for the universal chords. The top and bottom of the base of the EZ chord device is defined as the upper and lower side of the guitar chord scale as shown on any standard guitar chart. Just the same, the top and bottom of the EZ chord device is defined as the upper and lower side of the chord scale (actual size) as shown on the chord device itself.

One EZ chord is a device that when manipulated by a human hand, or an artificial hand, is pressed and positioned onto a guitar neck, fret and strings to form and sound guitar chords and/or notes.

DRAWINGS—FIGURES

DRAWING—REFERENCE NUMBERS

Figure 1A:
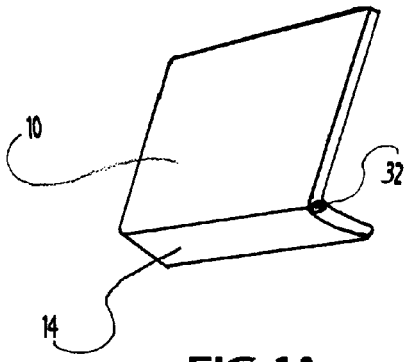
FIG. 1A to 1C is a perspective geometric outside front and side view, inside back and side view, and side view of the "EZ chord" learning chord device, adjustable lock-screw type.

10 outside front base
12 inside back base
14 bottom-lower gripping angle
16 top-upper gripping angle
18 keys
20 key pad
22 chord scale
24 braille nodules
26 guitar neck
28 guitar fret
30 guitar strings
32 screw
34 nut
36 slide grove for dial-a-chord
38 hinge
40 EZ chord

DETAILED DESCRIPTION—FIGS. 1A TO 4A—PREFERRED EMBODIMENT

Figure 1B:
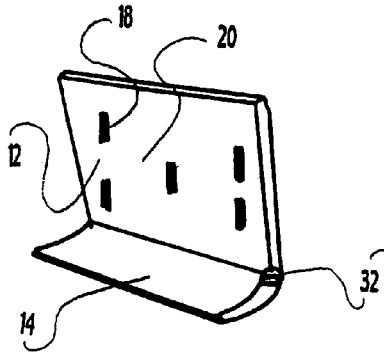
Figure 1C:
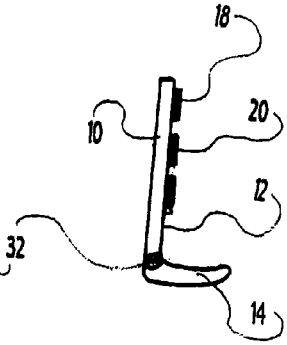
Figure 1D:
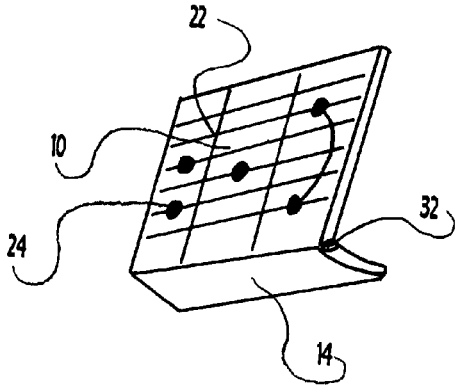
FIGS. 1D and 1E is a perspective geometric outside front and side view, and inside back and side view of the "EZ chord" learning chord device with the guitar chord scale and braille nodules laminated on the outside front of the base.
Figure 1E:
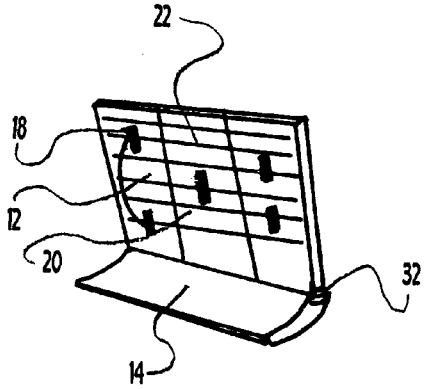

A preferred embodiment of the Handi-Guitar "EZ chord" learning chord device of the present invention is illustrated in FIG. 1A (outside front and side view), FIG. 1B (inside back and side view), FIG. 1C (side view), FIG. 1D (outside front and side view) with the chord scale laminated on the base, and FIG. 1E (inside back and side view) with the chord scale laminated on the base.

Figure 2A:
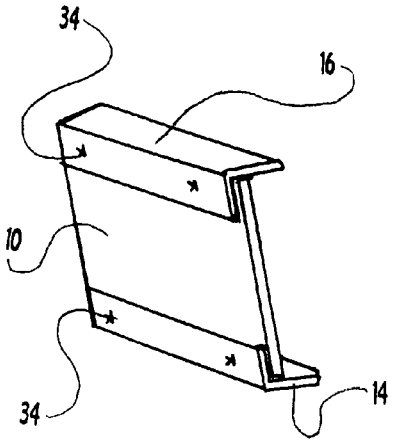
FIG. 2A to 2C is a perspective geometric outside front and side view, inside back and side view, and side view of the "EZ chord" universal chord device, adjustable grip type.
Figure 2B:
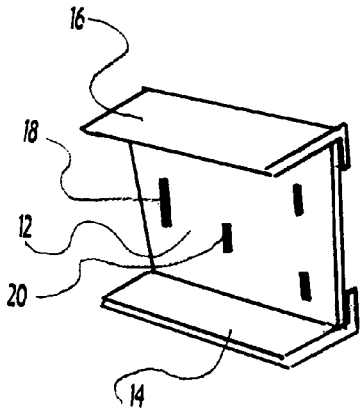
Figure 2C:
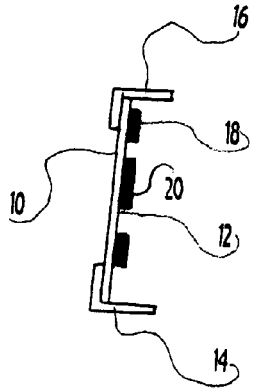
Figure 2D:
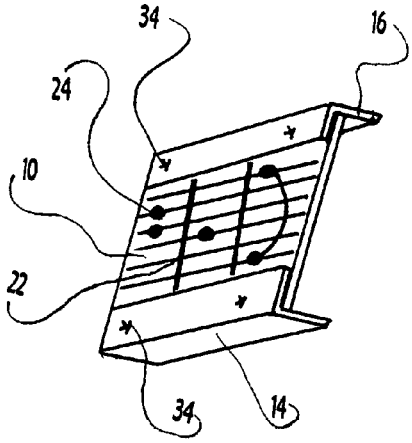
FIGS. 2D and 2E is a perspective geometric outside front and side view, and inside back and side view of the "EZ chord" universal chord device, with the guitar chord scale and braille nodules laminated on the outside front of the base.
Figure 2E:
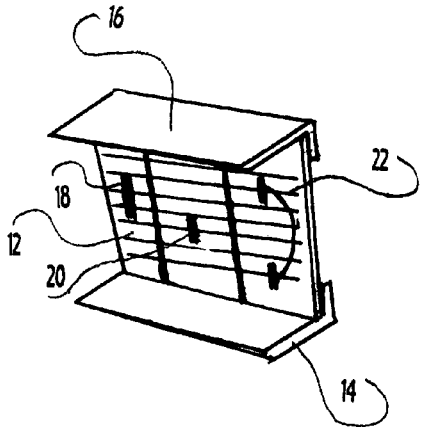

A preferred embodiment of the Handi-Guitar "EZ chord" universal chord device of the present invention is illustrated in FIG. 2A (outside front and side view), FIG. 2B (inside back and side view), FIG. 2C (side view), FIG. 2D (outside front and side view) with the chord scale laminated on the base, and FIG. 2E (inside back and side view) with the chord scale laminated on the base.

Figure 3A:
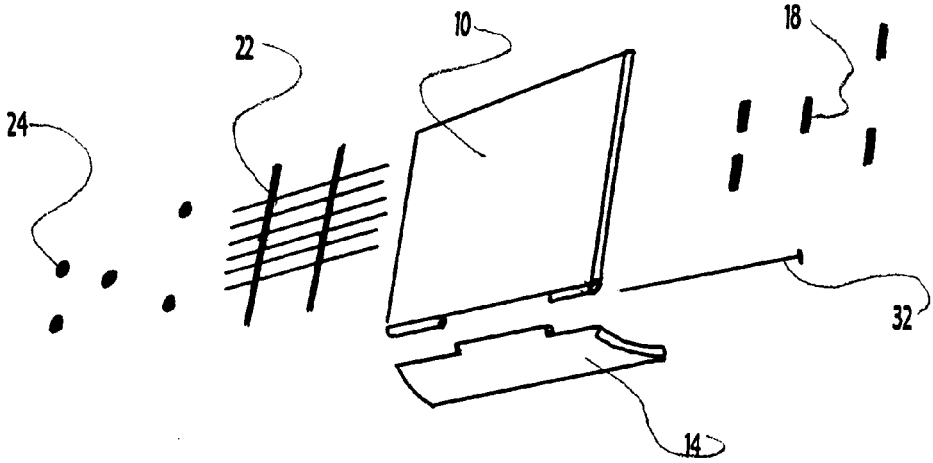
FIG. 3A is a perspective geometric view of the "EZ chord" learning chord device (dissected), adjustable lock-screw type.

A preferred embodiment of the Handi-Guitar "EZ chord" learning chord device of the present invention is illustrated in FIG. 3A (dissected view), adjustable lock-screw type.

Figure 4A:
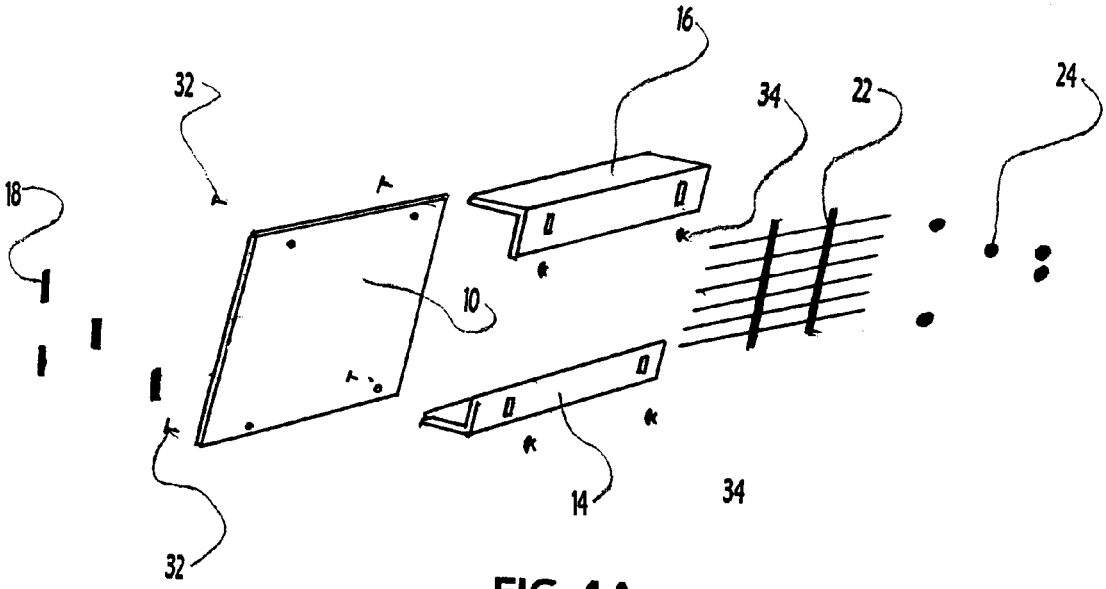
FIG. 4A is a perspective geometric view of the "EZ chord" universal chord device (dissected), adjustable grip type.

A preferred embodiment of the Handi-Guitar "EZ chord" universal chord device of the present invention is illustrated in FIG. 4A (dissected view), adjustable grip type.

The Handi-Guitar, EZ Chord has a thin base 10, 12 of square or rectangular shaped hard material which does not bend. At the bottom of the base 10, 12 is a slightly beveled gripping angle 14 for the learning chord. At the top and bottom of the base 10, 12 are slightly beveled gripping angles 14, 16 for the universal chord. Gripping angles are made adjustable by screws 32 and nuts 34.

For the preferred embodiment the base is made of clear plastic such as plexy glass, but may be comprised of wood, metal, rubber, fiber glass, vinyl, cement, epoxy, felt, polyurethane, polypropylene, polyethylene, varnish, nylon, leather, various glued fibrous materials, cardboard, paper, various plasticized materials, various metallic materials, various rubberized materials, or many other substances which can be fabricated or formed into the said chord device.

The body of the EZ chord is a square or rectangular shape but may consist of various shapes such as a circle, triangle, hectagon, pentagon, octagon, or various other sizes and shapes such as a glove type with finger holes, or may come with or without a strap.

On the inside back of the base 12 are keys 18 that form a key pad 20. On the preferred embodiment the keys are comprised of silicone rubber, but may be made of various plasticized materials, cardboard, felt, paper, laminated materials, glued materials, vinyl, epoxy, rubberized and metallic materials ect.

On the outside front of the base 10 is a chord scale 22. On the preferred embodiment the chord scale is a clear thin laminated (sticker) with dark lines depicting the (actual size) guitar scale. The chord scale duplicates that of the same scale on any instruction chart, and is the same size as the guitar neck, fret and strings. The chord scale may be painted, drawn, etched, carved, pasted, glued, laminated, or depicted in various ways and forms on the outside, inside, or sandwiched in the center of the base.

On the chord scale are braille nodules 24 which serve as a reference guide for the proper placement of fingers onto the EZ chord. Braille nodules 24 are flat and round on one side, and mounded or protruded on the opposite side, and are about the same size as a human finger tip. The nodules are made of silicone rubber but may consist of various rubberized materials, various plasticized materials, various metallic materials, vinyl, epoxy, fiber glass, varnish, nylon, wood, paper, glued materials, ect.

The base 10, 12 of the Handi-Guitar, EZ chord device is typically 1/16 to 1/4 inch thickness and has overall dimensions roughly 2"×2 " (square shaped) to 2"×3" (rectangle shaped) for larger chords, and 1-3/4"×1-3/4" (square shaped) to 1-1/2"× 1-3/4" (rectangle shaped) for smaller chords. Smaller chords are generally made for children's guitars. However, the EZ chord devices may vary is sizes and/or shapes. The outer corners of the base 10, 12 and gripping angles 14, 16 are typically rounded and beveled to avoid snagging and/or personal injury. Also, when the Handi-Guitar, EZ chord device is held firmly against the bottom or top of the guitar neck, the slightly beveled and rounded gripping angles provide a "rolling motion" as the chord device is pulled away and repositioned in repetition with the music notes being played.

FIGS. 5A to 5C, and 6A—Additional Embodiments

Figure 5A:
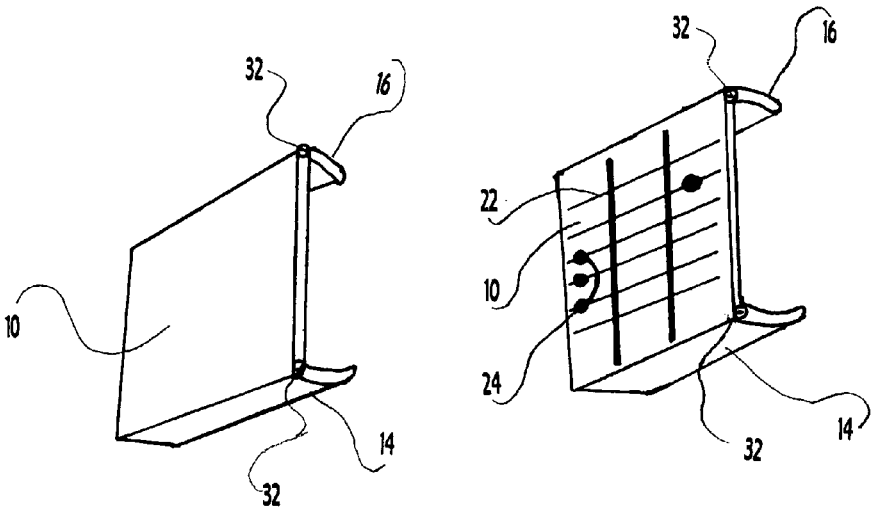
FIG. 5A to 5C is a perspective geometric outside front and side view, inside back and side view, and side view of the "EZ chord" universal chord device, adjustable lock-screw type.
Figure 5B:
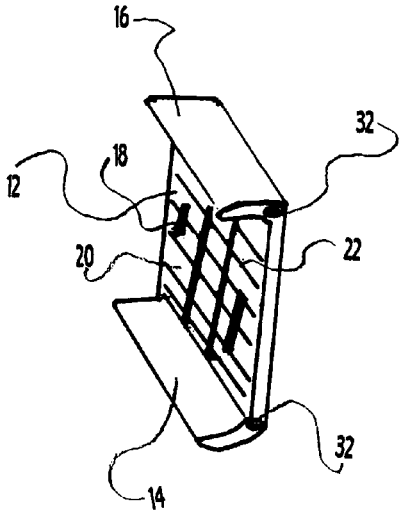
Figure 5C:
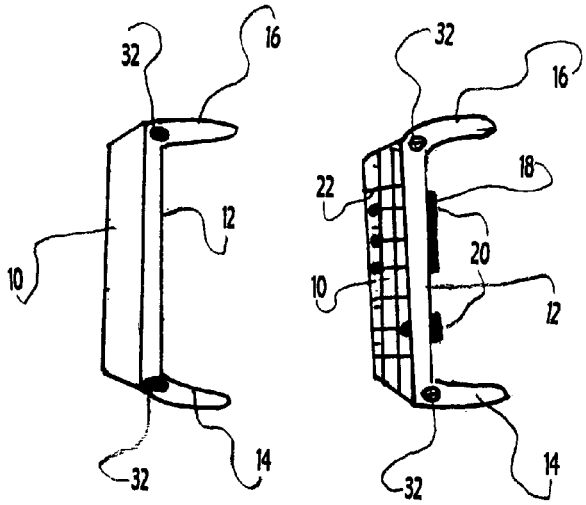
Figure 6A:
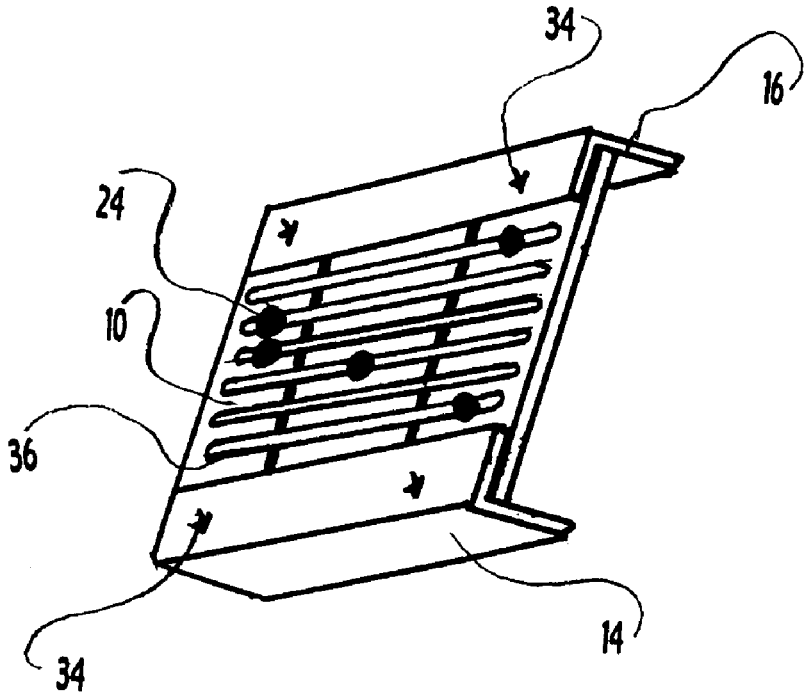
FIG. 6A is a perspective geometric outside front and side view of the "EZ chord" universal chord device, dial-a-chord type.

Additional embodiments of the Handi-Guitar, "EZ chord" universal chord device of the present invention is illustrated in FIG. 5A (outside front and side view), 5B (inside back and side view), FIG. 5C (side view) of the adjustable lock-screw type, and FIG. 6A (outside front and side view) of the dial-a-chord, adjustable grip type.

Figure 7A:
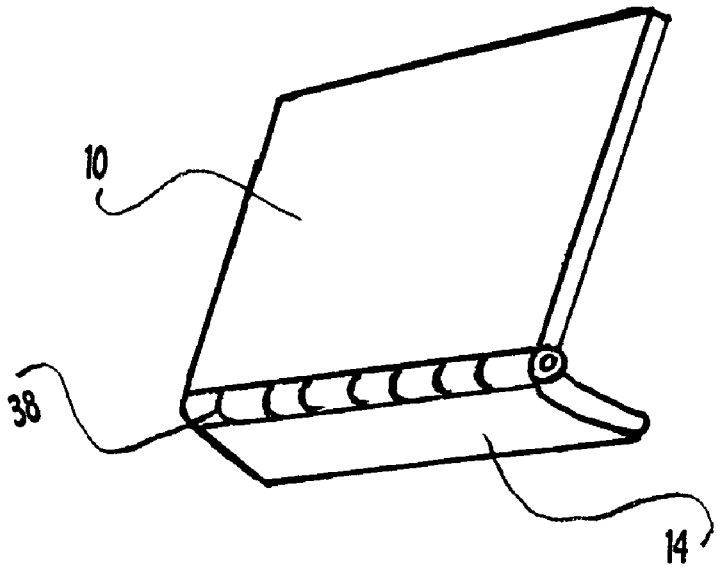
FIG. 7A is a perspective geometric outside front and side view of the "EZ chord" learning chord device, hinge type.

FIG. 7A—Alternative Embodiments

Alternative embodiments of the Handi-Guitar, "EZ chord" learning chord device of the present invention is illustrated in FIG. 7A (outside front and side view) of the hinge type device. Other alternative embodiments may have various possibilities with regard to the relative disposition of shape, dimensions, and gripping points, as well as various colors or non-colors. Further embodiments may include various adjustable or fixed gripping points. A precisely engineered "EZ chord" device may appear exactly like the preferred embodiments with an exception being that of permanent or fixed gripping angles.

Figure 8A:
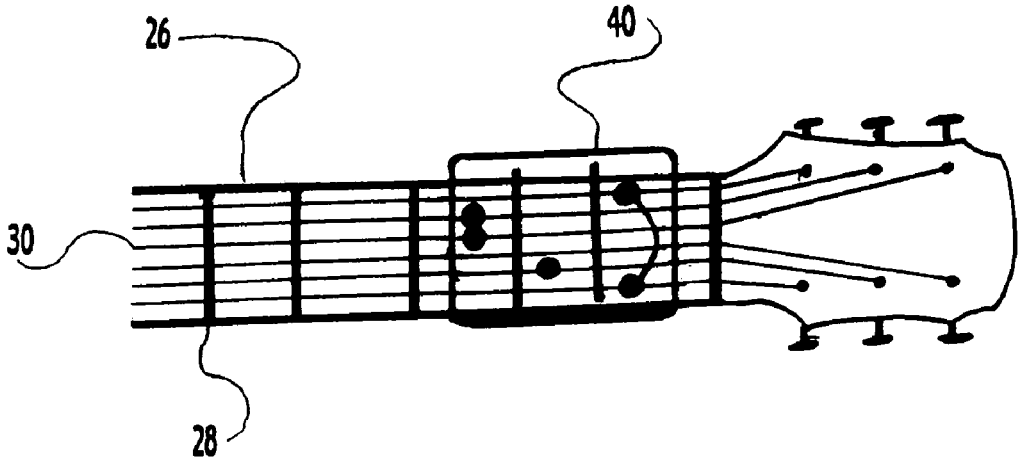
FIG. 8A is an example of the proper placement of the "EZ chord" learning chord device, onto the guitar neck, frets and strings.
Figure 9A:
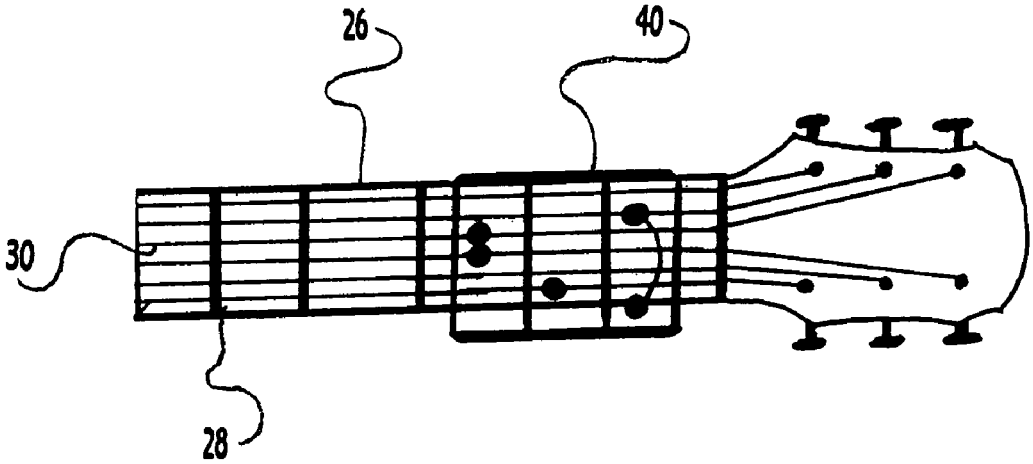
FIG. 9A is an example of the proper placement of the "EZ chord" universal chord device, onto the guitar neck, frets and strings.
Figure 1A:
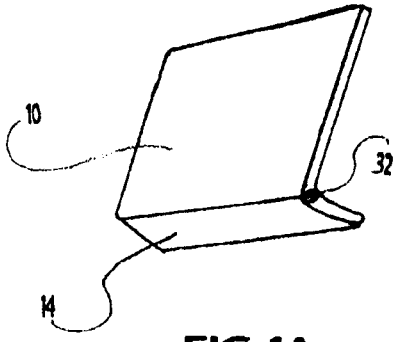
Figure 1B:
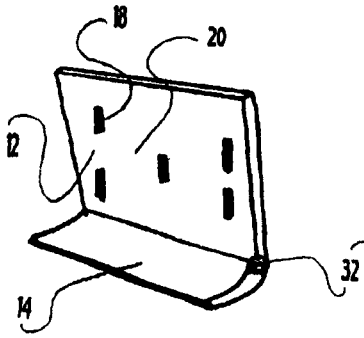
Figure 1C:
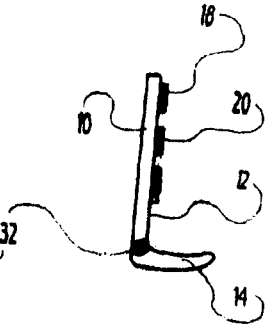
Figure 1D:
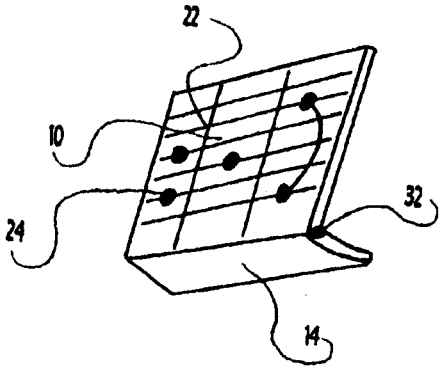
Figure 1E:
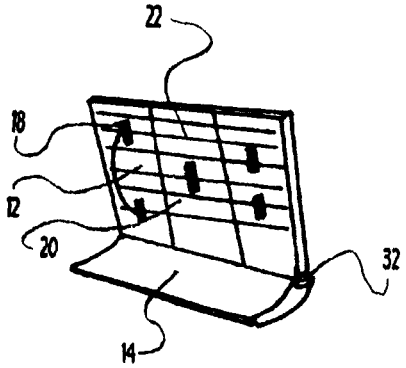
Figure 2A:
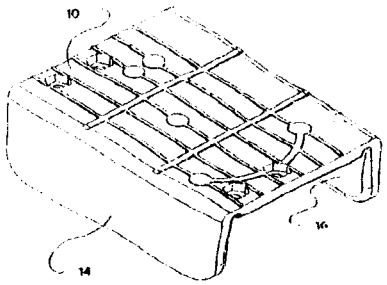
Figure 2B:
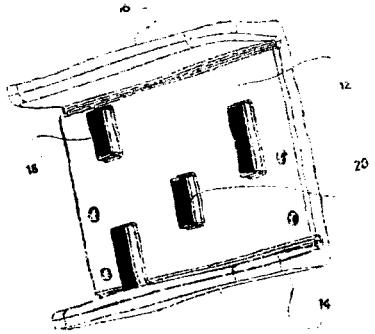
Figure 2C:
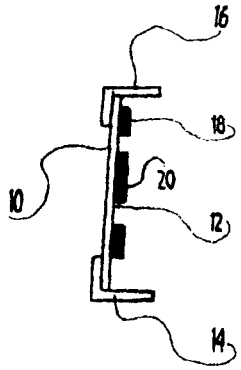
Figure 2D:
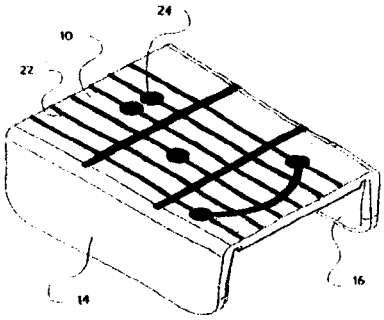
Figure 2E:
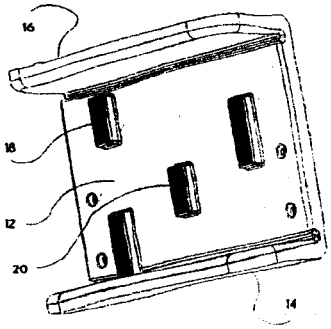
Figure 3A:
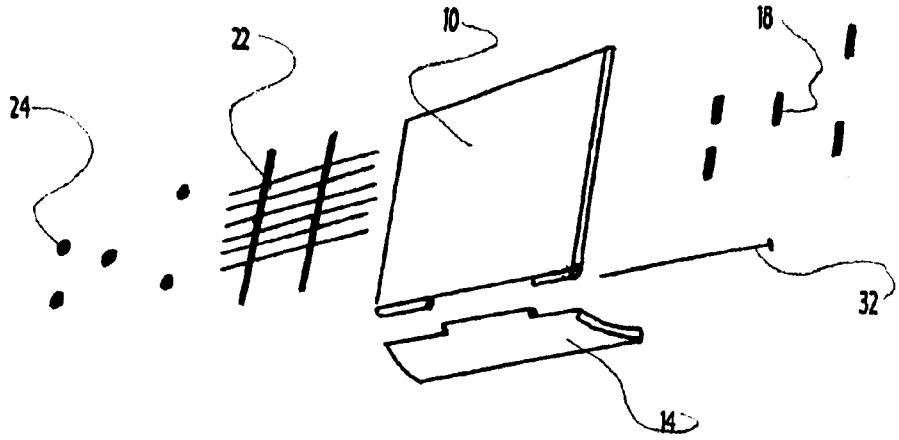
Figure 4A:
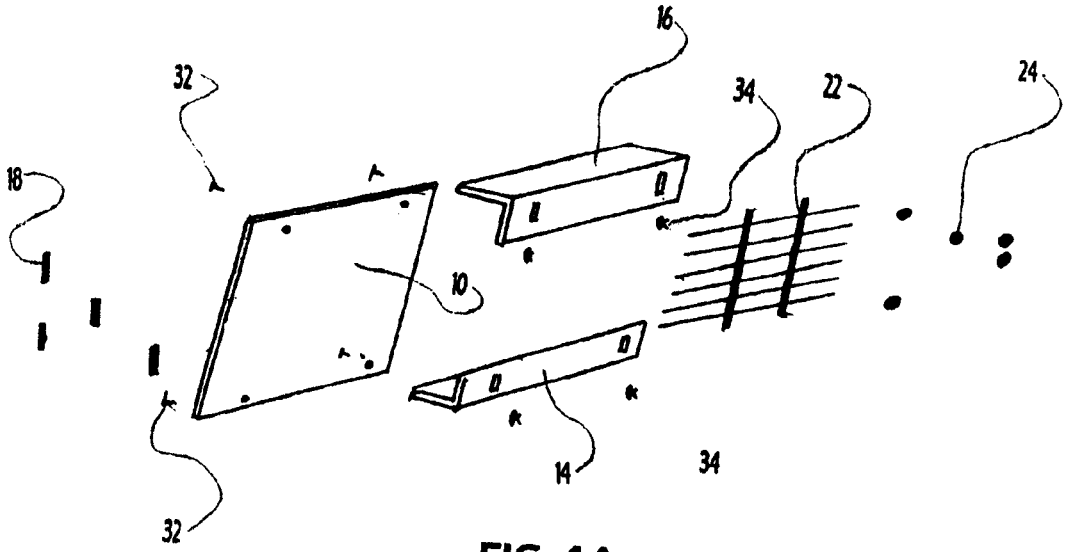
Figure 5A:
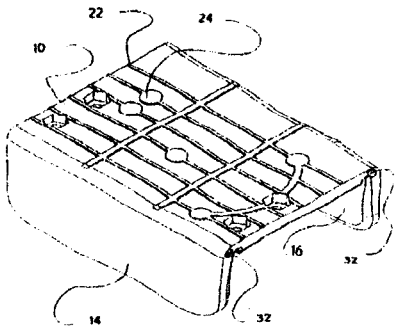
Figure 5B:
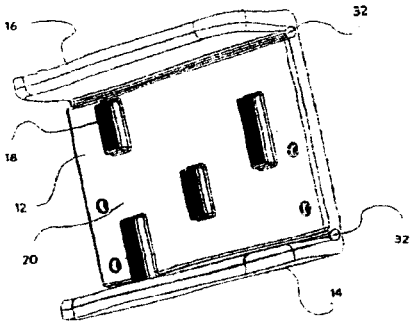
Figure 5C:
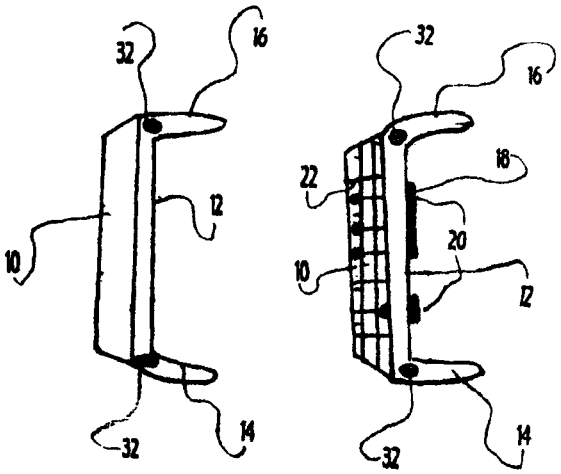
Figure 6A:
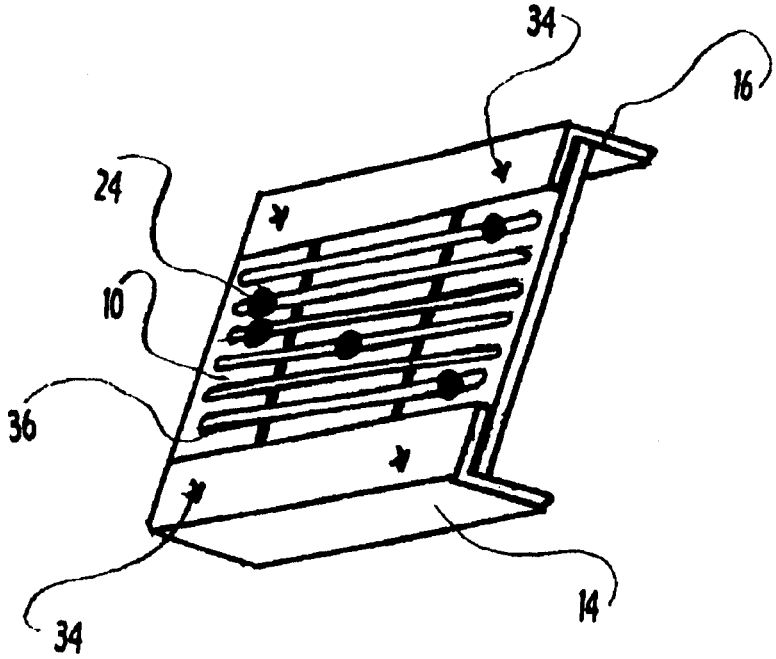
Figure 7A:
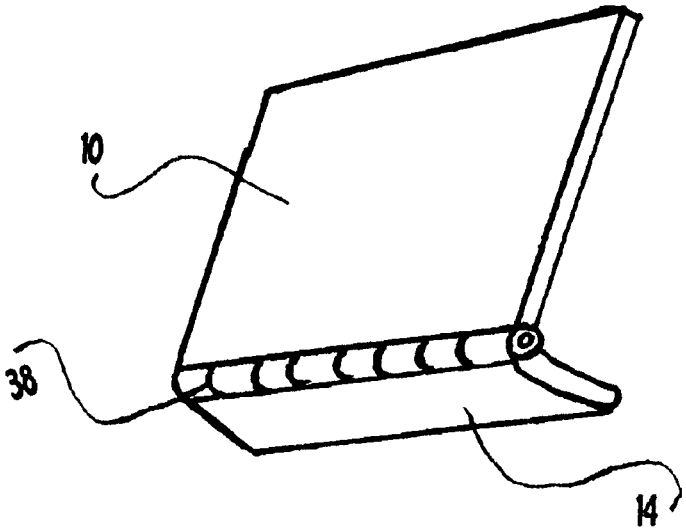
Figure 8A:
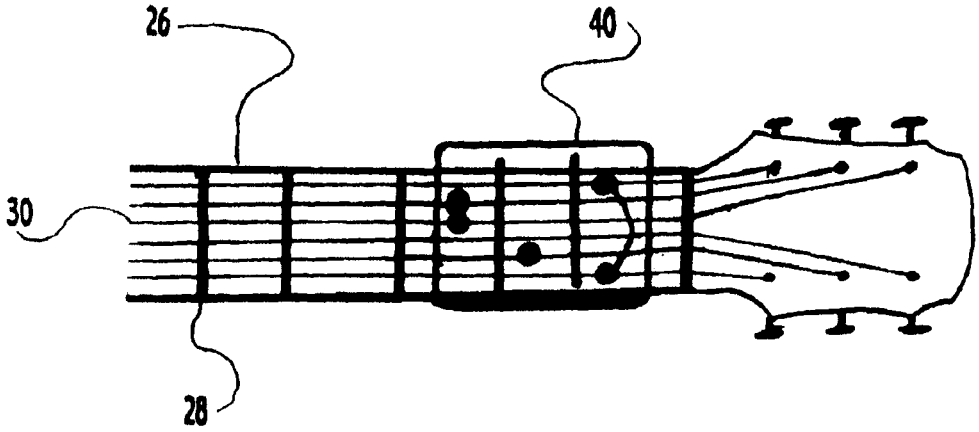
Figure 9A:
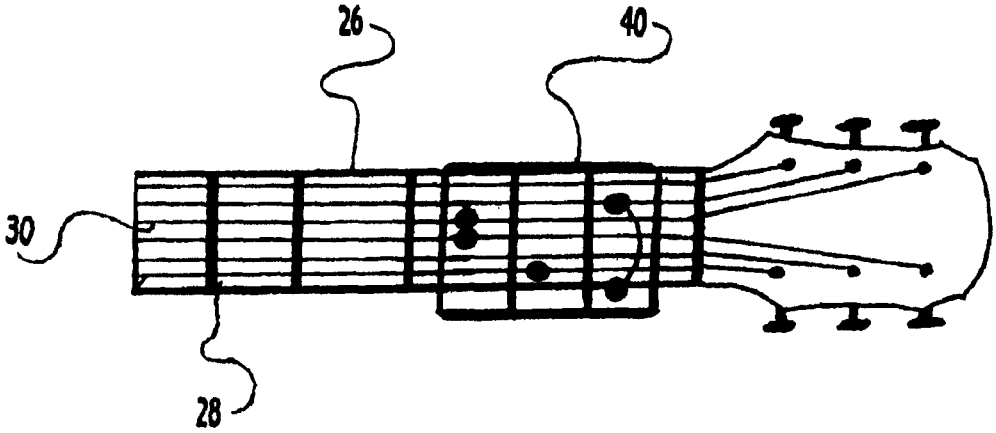

Operation—FIGS. 8A and 9A

The manner of using the Handi-Guitar "EZ chords" are identical to the points of finger placement on the guitar neck, fret and strings, for any desired chord (without the plastic invention device). Namely, to play the "F Major chord" on the first, second and third frets on any guitar neck, the EZ chord 40 (FIG. 8A, learning chord device) with the "F" configuration is selected from the "chord group". While holding the outside front of the base 10 in the palm of the hand, and placing the fingers on the braille nodules 24, the chord is sounded into a note by holding the bottom gripping angle 14 to the bottom of the guitar neck 26, and pressing the inside back base 12 and the key pad 20 to the frets 28 and the strings 30.

In the same fashion as above, to play the "B Minor chord" on the same first, second and third frets as named above, the EZ chord 40 (FIG. 9A, universal chord device) with the "F" configuration is selected from the "chord group". To sound the "B Minor" chord into a note, follow the same procedures as above with the exception that the top gripping angle 16 is held against the top of the guitar neck 26. The universal chord in FIG. 9A, when manipulated in a vertical fashion and on the same frets as the learning chord in FIG. 8A, can perform the function of both chords. Learning chords are for the purpose of teaching guitar chords to people who are unfamiliar with the guitar. Universal chords form a multi-function of chords on the chord scale, and may be used both by beginners and experienced guitar players. EZ chord devices of every chord may be used in the same manner as above depending on the type of chord used (learning, or universal). The "F" chord is used as an example above because it is the most common and the most difficult to manipulate. Depending on the chord device being used, once the guitar player has properly placed the EZ chord onto the guitar neck 26 and strings 30, it may be manipulated vertically, parallel or horizontally along, and/or between the guitar frets as a means for producing a range of guitar chords and notes. The procedures stated above are the same for all guitar chords on any scale including 6-string guitars, 12-string guitars, 5-string guitars, bass guitars, and various other guitar type instruments.

CONCLUSION, RAMIFICATIONS, AND SCOPE

Accordingly, the reader will see that the Handi-Guitar, EZ chords can be used by mentally, physically, and visually handicapped people easily and conveniently, to play or learn to play the guitar. In addition, the EZ chords can be used by non-handicapped people of all ages to learn and play the guitar in a timely and much simplified fashion. The quality of sound combined with the ease of using the chord devices far exceeds the conventional way of reading books and charts to learn to play the guitar. The advantage of the chord devices to certain handicapped people is priceless in a sense that there is no common or general knowledge of any devices made for blind, amputee, or people with joint diseases, or mentally impaired people, to play or learn to play the guitar. Furthermore, the EZ chord "reverse" system of teaching children to play the guitar will no doubt create a much wider audience of guitar playing adults in the future.

Although the description above contains many specifications, these should not be construed as limiting the scope of the invention but as merely providing illustrations of some of the presently preferred embodiments of this invention. For example the EZ chord devices can have other shapes, such as circular, oval, trapezoidal, triangular, ect.

The base and gripping angles can have various other shapes. Gripping angles can be fixed, adjustable, or fitted with hinges, tracks, ect.

The guitar itself can be fitted with fixed hinges, tracks, and/or devices which perform the same function as the base of this invention. The function of the EZ chord device can be duplicated by means of electronic devices. Such devices are the "electronic collar" and the "electronic neck" as described in detail in the ppA for this invention.

Thus, the scope of the invention should be determined by the appended claims and their legal equivalents, rather than by the examples given.

I claim:

1. A device to assist a user in generating a chord on a guitar comprising:

a clear and a plastic body having a set of matched strings laminated on its outward face sized and set apart to actual scale, said body is a generally planar body having an upper end generally parallel to a lower end and an inner surface parallel to an outer surface;

a gripping base affixed at said lower end that extends laterally inward; and a means for engaging the guitar strings mounted to said guitar underneath said inner surface;

wherein said gripping base is adjustably affixed to said lower end.

2. A device to assist a user in generating a chord on a guitar comprising:

a clear and a plastic body having set of matched strings laminated on its outward face sized and set apart to actual scale, said body is a generally planar body having an upper end generally parallel to a lower end and an inner surface parallel to an outer surface;

a gripping base affixed at said lower end that extends laterally inward; and at least one key pad mounted to and extending from said inside surface and provided as the means for engaging the guitar strings mounted to the guitar underneath said inner surface; and chord indicia provided on said outer surface of said body provided as means to mark the proper placement of fingers to produce said chord;

wherein if said gripping base is aligned with the neck of said guitar and said body is placed over said strings of said guitar, said key pad mechanically impinges said strings when said fingers are placed on said chord indicia.

3. The device to assist a user in generating a chord on the guitar of claim 2, wherein a plurality of said key pads are provided on and positioned to said inner surface of said body in a manner that generates said guitar chord, each one of said key pads is positioned opposite one of said chord indicia on said outside surface of said body.

4. The device to assist a user in generating a chord on the guitar of claim 2, wherein said planar body is formed of a generally rigid material and said key pads are formed of a generally resilient material.

5. The device for assisting a user in generating a chord on the guitar of claim 3, wherein said chord indicia comprises nodules in the form of indentations or protrusions that corresponds to said chord generated.

6. The device to assist a user in generating a chord on the guitar of claim 4, wherein said generally rigid material is selected from the group comprising: polycarbonate; wood; metal; rubber; fiberglass; vinyl; cement; epoxy; felt; polyurethane; polypropylene; polyethelyne; varnish; nylon; leather; glued fibrous materials; metalized materials; and plasticized materials.

7. The device to assist a user in generating a chord on the guitar of claim 4, wherein said key pads are made of a material selected from the group comprising: silicone rubber; cardboard; felt; paper; laminated materials; glued materials; vinyl; epoxy; rubberized materials; and metallic materials.

8. A device for assisting a user in generating a chord on guitar, comprising:

a clear and a plastic body having a set of matched strings laminated on its outward face sized and set apart to actual scale, said body is a generally planar body having an upper end generally parallel to a lower end and an inner surface parallel to an outer surface, wherein said planar body is formed of a generally rigid material a gripping base affixed at said lower end that extends laterally inward, wherein if said gripping base is aligned with the neck of said guitar and said body is placed over said strings of said guitar, said key pad mechanically impinges said strings when said fingers are placed on said chord indicia;

at least one key pad mounted to and extending from said inside surface and provided as the means for engaging the guitar strings mounted to the guitar underneath said inner surface, provided on and positioned to said inner surface of said body in a manner that generates said guitar chord, each one of said key pads is positioned opposite one of said chord indicia on said outside surface of said body, and said key pad is formed of a generally resilient material;

chord indicia provided on said outer surface of said body provided as means to mark the proper placement of fingers to produce said chord, wherein said chord indicia comprises nodules in the form of indentations or protrusions that corresponds to said chord generated, and tactile guides on said outer surface for indicting proper placement of a player's fingers for producing said guitar chord.

9. The device for assisting a user in generating a chord on a guitar of claim 8, wherein said tactile guides are formed in a manner selected from the group comprising: indentations; and protrusions.

10. The device to assist a user in generating a chord on the guitar of claim 1, wherein said gripping base forms a beveled gripping angle along the length of and relative to said body.

11. A device to assist a user in generating a chord on a guitar, said device comprising:

a clear and a plastic body having a set of matched strings laminated on its outward face sized and set apart to actual scale, said body is a generally planar body having an upper end generally parallel to a lower end and an inner surface parallel to an outer surface;

means to engage the guitar strings mounted to said guitar underneath said inner surface;

a neck guide affixed along the entire length of said upper end and extending laterally inward; and a gripping base affixed along the entire length of said lower end and extending laterally inward;

wherein said neck guide and said gripping base generally provide lateral tracking about the neck of said guitar for guiding said planar body smoothly along said strings of said guitar.

12. The device to assist a user in generating a chord on the a guitar of claim 11, wherein said gripping base and said neck guide form an adjustable beveled gripping angle relative to said body so as to provide a means to allow for the adjustments in the width of said neck of said guitar and angles of said gripping base and said neck guide relative to said planar body.

13. The device to assist a user in generating a chord on the guitar of claim 11, wherein said means to engage said guitar strings comprises at least one key pad mounted to and extending from said inner surface, said at least one key pad is positioned opposite a chord indicia on said body and is adapted to press said guitar strings on the finger board in the same manner as a human finger tip.

14. The device to assist a user in generating a chord on the guitar of claim 13, wherein a plurality of said key pads are provided on and positioned to said inner surface of said body in a manner that mechanically impinges said guitar strings to generate said chord when fingers are placed on said chord indicia positioned on said outside surface of said body opposite each one of said key pads, said chord indicia mark the proper placement of said fingers.

15. The device to assist a user in generating a chord on the guitar of claim 14, wherein said planar body is formed of a generally rigid material and said key pads are formed of a generally resilient material.

16. A device for assisting a user in generating a chord on a guitar, said device comprising;

a clear and a plastic body having a set of matched strings laminated on its outward face sized and set apart to actual scale, said body is a generally planar body having an upper end generally parallel to a lower end and an inner surface parallel to an outer surface, said planar body is formed of a generally rigid material said planar body is formed of a generally rigid material and said key pads are formed of a generally resilient material means to engage the guitar strings mounted to said guitar underneath said inner surface, wherein said means to engage said guitar strings comprises at least one key pad mounted to and extending from said inner surface, said at least one key pad is positioned opposite a chord indicia on said body and is adapted to press said guitar string on the finger board in the same manner as a human finger tip;

a neck guide affixed along the entire length of said upper end and extending laterally inward, wherein said neck guide and said gripping base generally provide lateral tracking about the neck of said guitar for guiding said planar body smoothly along said strings of said guitar;

a gripping base affixed along the entire length of said lower end and extending laterally inward;

wherein a plurality of said key pads are provided on and positioned to said inner surface of said body in a manner that mechanically impinges said guitar strings to generate said chord when fingers are placed on said chord indicia positioned on said outside surface of said body opposite each one of said key pads, said chord indicia mark the proper placement of said fingers, and said key pads are formed of a generally resilient material; and a chord indicia on said outer surface, wherein said chord indicia corresponds to the guitar chord generated.

17. A device for assisting a user in generating a chord on a guitar, said device comprising;

a clear and a plastic body having a set of matched strings laminated on its outward face sized and set apart to actual scale, said body is a generally planar body having an upper end generally parallel to a lower end and an inner surface parallel to an outer surface, said planar body is formed of a generally rigid material said planar body is formed of a generally rigid material and said key pads are formed of a generally resilient material, means to engage the guitar strings mounted to said guitar underneath said inner surface, wherein said means to engage said guitar strings comprises at least one key pad mounted to and extending from said inner surface, said at least one key pad is positioned opposite a chord indicia on said body and is adapted to press said guitar string on the finger board in the same manner as a human finger tip;

a neck guide affixed along the entire length of said upper end and extending laterally inward, wherein said neck guide and said gripping base generally provide lateral tracking about the neck of said guitar for guiding said planar body smoothly along said strings of said guitar;

a gripping base affixed along the entire length of said lower end and extending laterally inward:

wherein a plurality of said key pads are provided on and positioned to said inner surface of said body in a manner that mechanically impinges said guitar strings to generate said chord when fingers are placed on said chord indicia positioned on said outside surface of said body opposite each one of said key pads, said chord indicia mark the proper placement of said fingers, and said key pads are formed of a generally resilient material; and, a chord indicia on said outer surface, wherein said chord indicia is formed by said planar body being generally translucent or transparent, and said keys being generally opaque.

18. The device to assist a user in generating a chord on the guitar of claim 16, wherein said chord comprises tactile guides on said outer surface that are raised or depressed to provide a means to easily identify said proper placement of said fingers.

19. A method to assist a user in generating a chord on an otherwise conventional guitar, said method comprises the steps:

Providing a fixed templated guide for placement along the neck of an otherwise conventional guitar, said templated guide is a thin, transparent guide having an actual sized and scaled representation of the strings of said guitar laminated on its face;

Adjusting said templated guide along said neck and said strings of said guitar such as to form a plurality of chords;

Adjusting the guitar string engagement of said templated guide such as to form a plurality of chords;

Mechanically impinging said templated guide against said neck and said strings of said guitar; said mechanical impingement is accomplished by means of placing fingers on nodules positioned on said guide at the proper placements for a guitar chord and Strumming said guitar strings in an otherwise conventional fashion;

wherein said templated guide engages selected guitar strings in a way that replicates the placement of finger tips in a predetermined manner such as to form a chord.

20. The method of claim 19, wherein said templated guide generally comprises:

a generally planar body having an upper end generally parallel to a lower end and an inner surface parallel to an outer surface; and a gripping base affixed along the length of said lower end and extending laterally inward.

21. The method of claim 19, wherein said templated guide generally comprises:

a generally planar body having an upper end generally parallel to a lower end and an inner surface parallel to an outer surface;

means to engage said strings mounted to said guitar underneath said inner surface;

a neck guide affixed along the entire length of said upper end and extending laterally inward; and a gripping base affixed along the entire length of said lower end and extending laterally inward;

wherein said neck guide and said gripping base generally provide lateral tracking about said neck of said guitar for guiding said planar body smoothly along said strings of said guitar.

22. The method of claim 19, further comprising the step of providing training feedback to the user to correlate said chord being played via a means for providing feedback.

23. The method of claim 22, wherein said training feedback is visual.

24. The method of claim 22, wherein said training feedback is tactile.

* * * * *

UNITED STATES PATENT AND TRADEMARK OFFICE

CERTIFICATE OF CORRECTION

PATENT NO. : 7,468,478 B2
APPLICATION NO. : 10/916575
DATED : December 23, 2008
INVENTOR(S) : Barry Mark Davis It is certified that error appears in the above-identified patent and that said Letters Patent is hereby corrected as shown below:

Delete the Title page and substitute therefore the attached Title page showing corrected number of Drawing Sheets in patent.

Delete Drawing Sheets 1-6 and substitute therefore the attached Drawing Sheets 1-19.

Figure 10A:
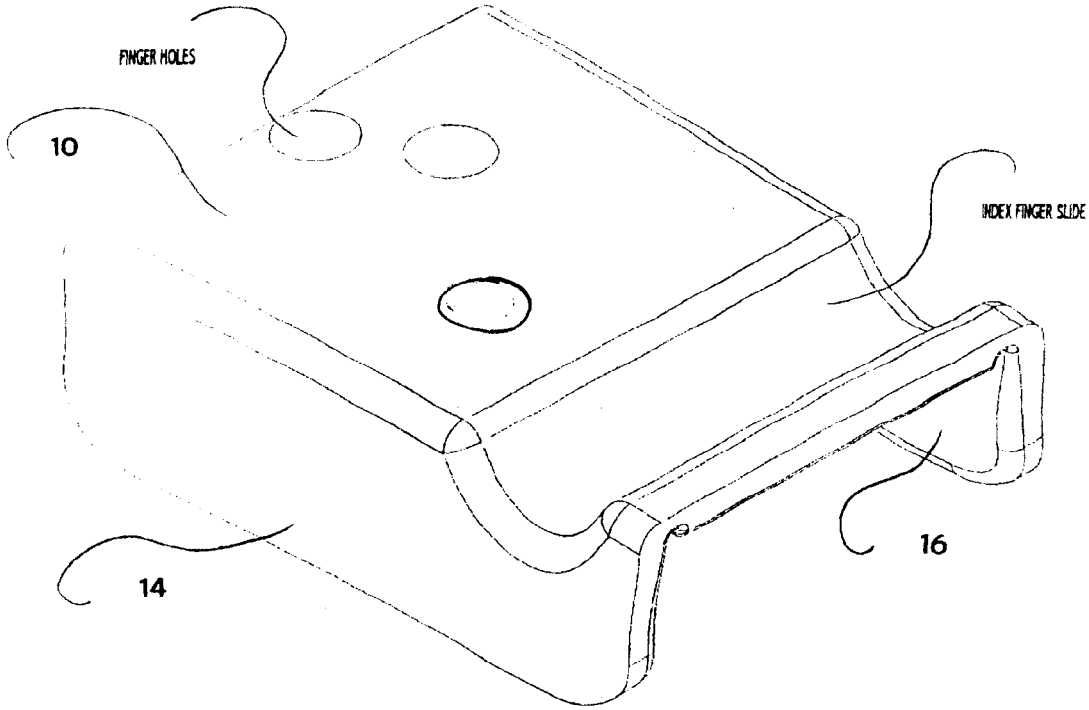

On Column 3, subsequent to line 50 and before line 51, please insert the following:

--Fig 10A is a perspective geometric outside front and side view of the "EZ Chord", universal chord device, glove type with finger holes.

Figure 10B:
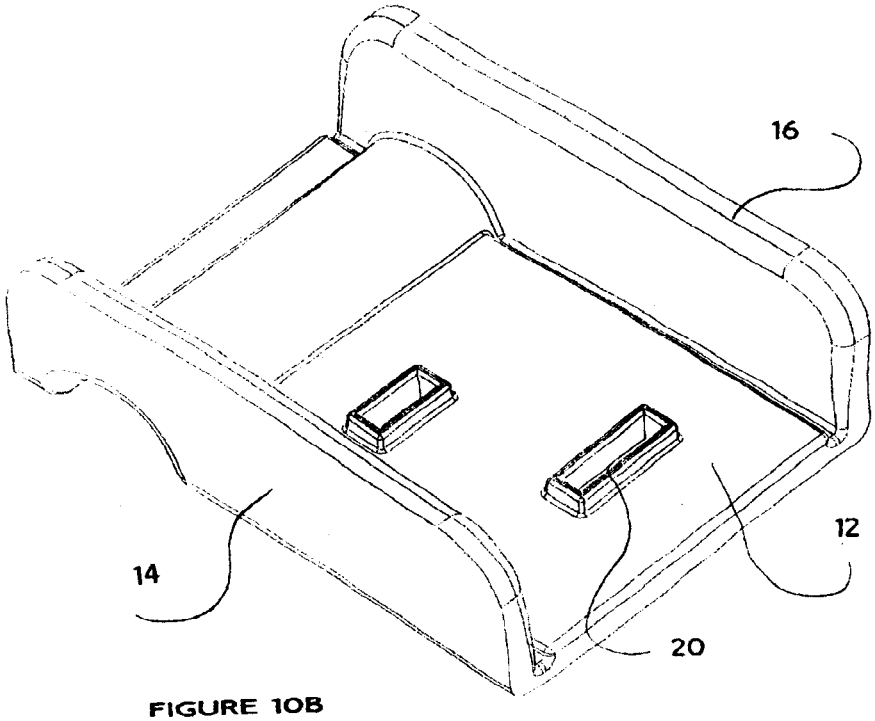

Fig 10B is a perspective geometric inside back and side view of the "EZ Chord" universal chord device, glove type with finger holes.

Figure 11A:
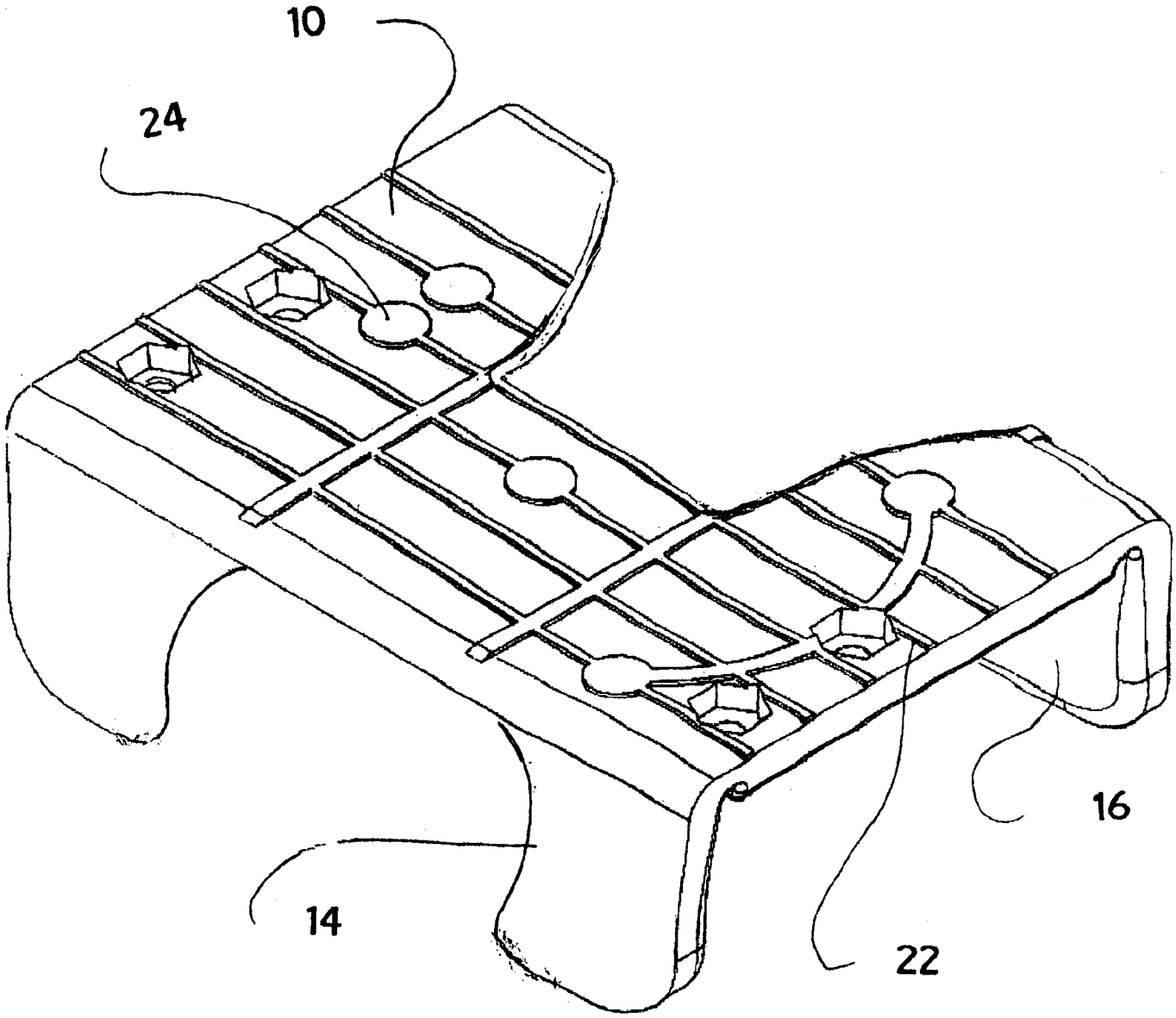

Fig 11A is a perspective geometric view of the "EZ Chord", universal chord device, glove type.

Figure 12A:
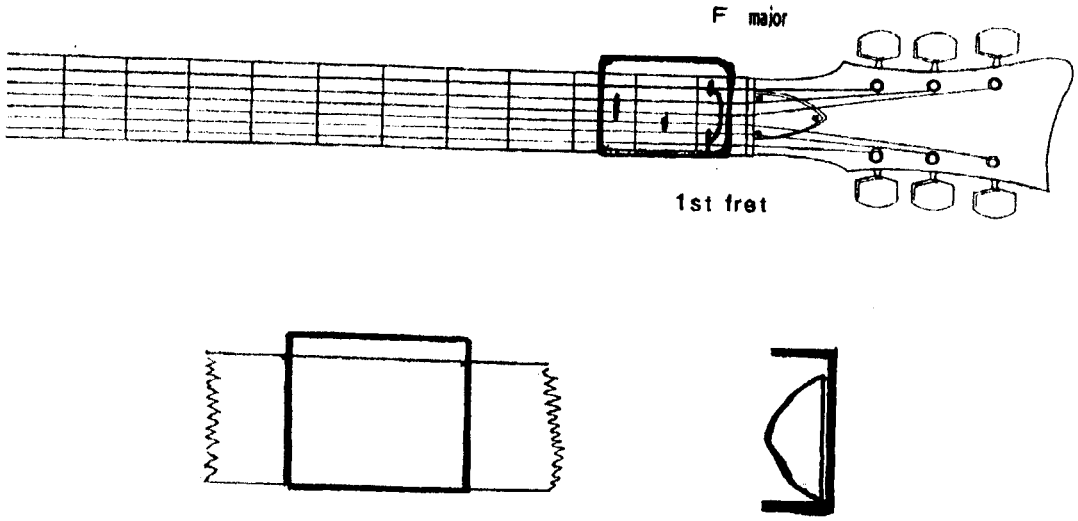

Fig 12A is an example of the proper placement of the "EZ Chord", universal chord device, onto the guitar neck, fret and strings. To form the "F Major" chord, place the "EZ. Char" front• bar pads onto the guitar neck just forward of the first fret. While holding the chord in the position above, the lower gripping angle of the chord device must be held firmly against the lower side of the guitar neck. Pressing the chord with even pressure will ensure that all of the keypad equal contact with the strings.

Figure 12B:
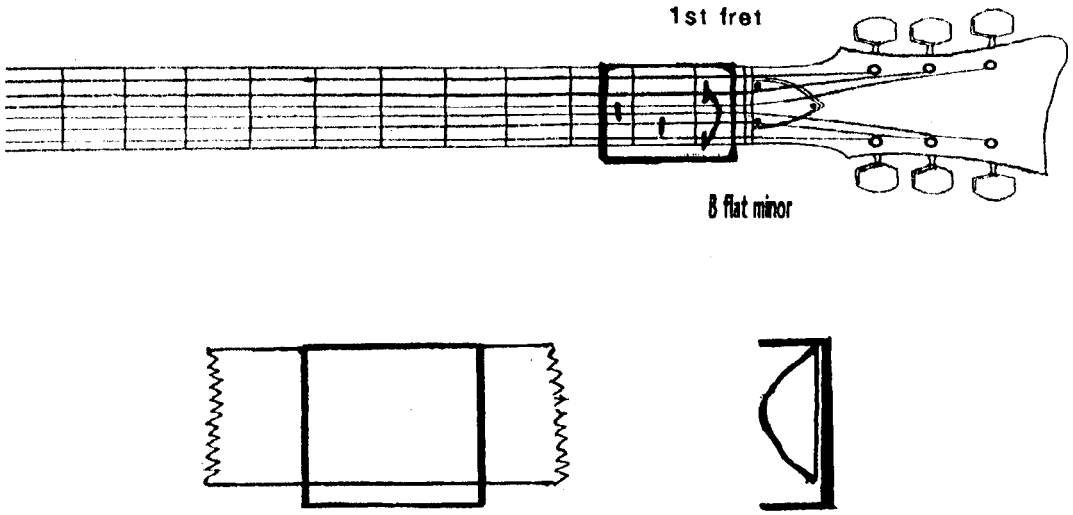

Fig 12B is an example of the proper placement of the "EZ Chord", universal chord device, onto the guitar neck, fret and strings. To form the "B Flat Minor" chord, place the "EZ Chord" front bar pads onto the guitar neck just forward the first fret. While holding the chord' the position above, the upper gripping angle of the chord device must be held firmly against the upper side of the guitar neck. Pressing the chord with even pressure will ensure that all of the eypads make equal contact with the strings.

Signed and Sealed this
Tenth Day of May, 2011

David J. Kappos

David J. Kappos
*Director of the United States Patent and Trademark Office*

Figure 13A:
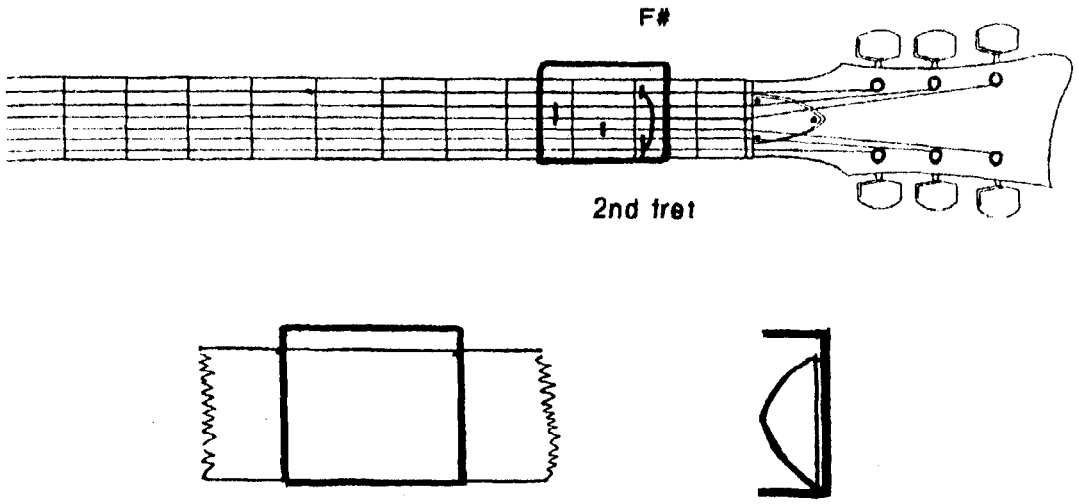

Fig 13A is an example of the proper placement of the "EZ Chord", universal chord device, onto the guitar neck, fret and strings. To form the "F # (sharp)" chord, place the "EZ Cord" front bar pads onto the guitar neck just forward of the second fret. While holding the cord in the position above, the lower gripping angle of the chord device must be held firmly against the lower side of the guitar neck. Pressing the chord with even pressure will ensure that all of the eypads make equal contact with the strings.

Figure 13B:
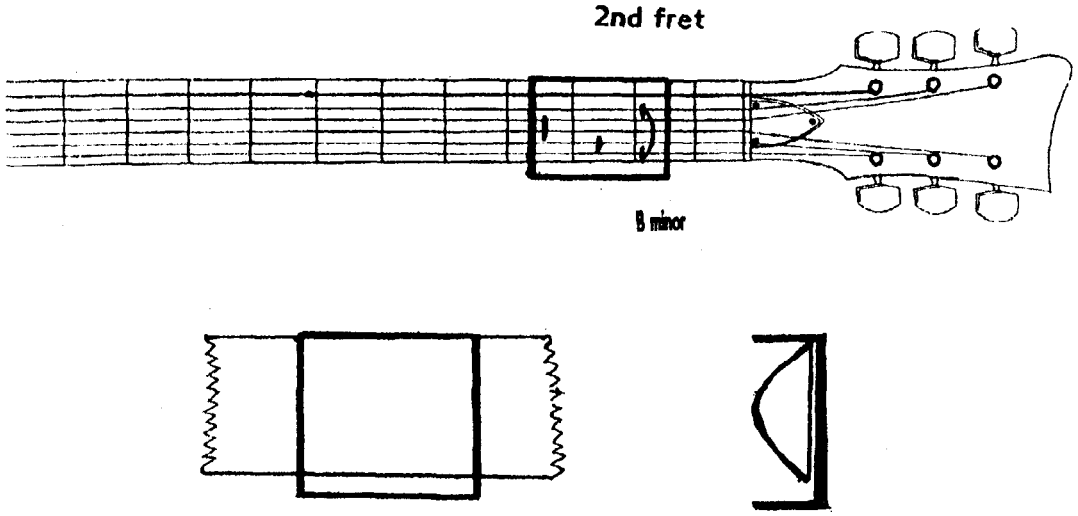

Fig 13B is an example of the proper placement of the "EZ Chord", universal chord device onto the guitar neck, frets and strings. To form the "B Minor" chord, place the "EZ Chord" front bar pads onto the guitar neck just forward of the second fret. While holding the chord' the position above, the upper gripping angle of the chord device must be held firmly against the upper side of the guitar neck. Pressing the chord with even pressure will ensure that all of the eyepads make equal contact with the strings.

Fig l4A is an example of the proper placement of the "EZ Chord", universal chord device, onto the guitar neck, fret and strings. To form the "G Major" chord, place the "EZ Chord" front bar pads onto the guitar neck just forward of the third fret. While holding the chord in e position above, the lower gripping angle of the chord device must be held firmly against the low side of the guitar neck. Pressing the chord with even pressure will ensure that all of the keypads make equal contact with the strings.

Figure 14A:
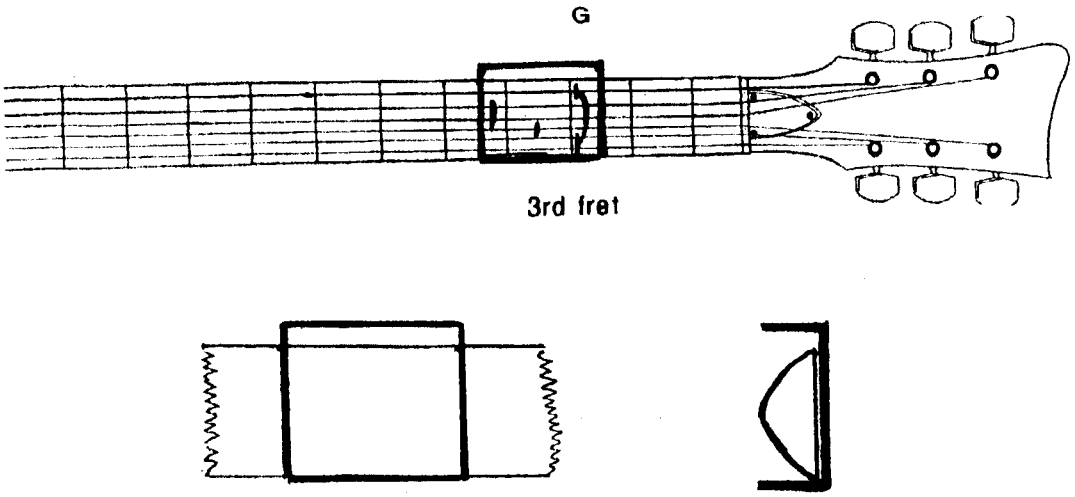
Figure 14B:
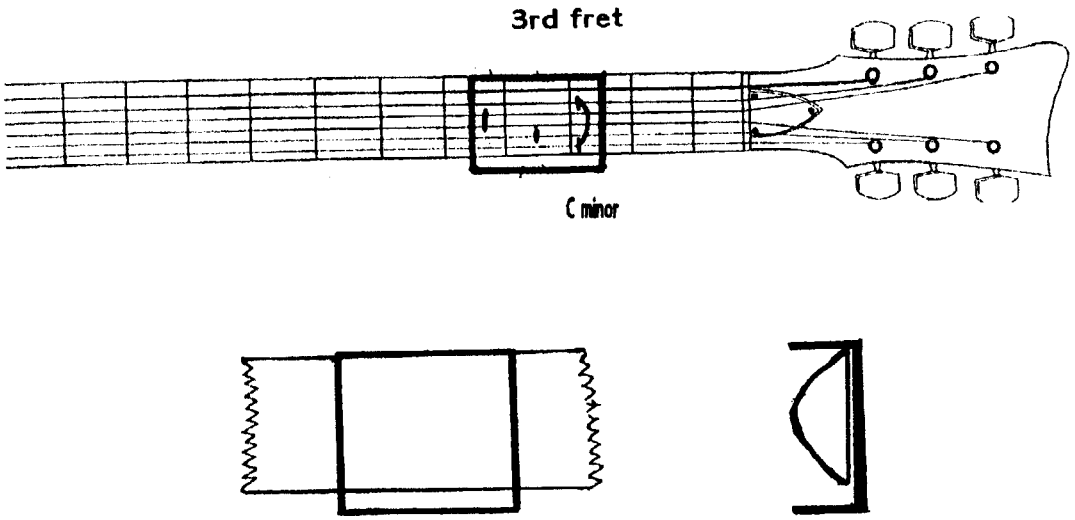

Fig 14B is an example of the proper placement of the "EZ Chord", universal chord device, onto the guitar neck, frets and strings. To form the "C Minor" chord, place the "EZ Chord" front bar pads onto the guitar neck just forward of the third fret. While holding the chord in the position above, the upper gripping angle of the chord device must be held firmly against the upper side of the guitar neck. Pressing the chord with even pressure will ensure that all of the keypad make equal Contact with the strings.

Figure 15A:
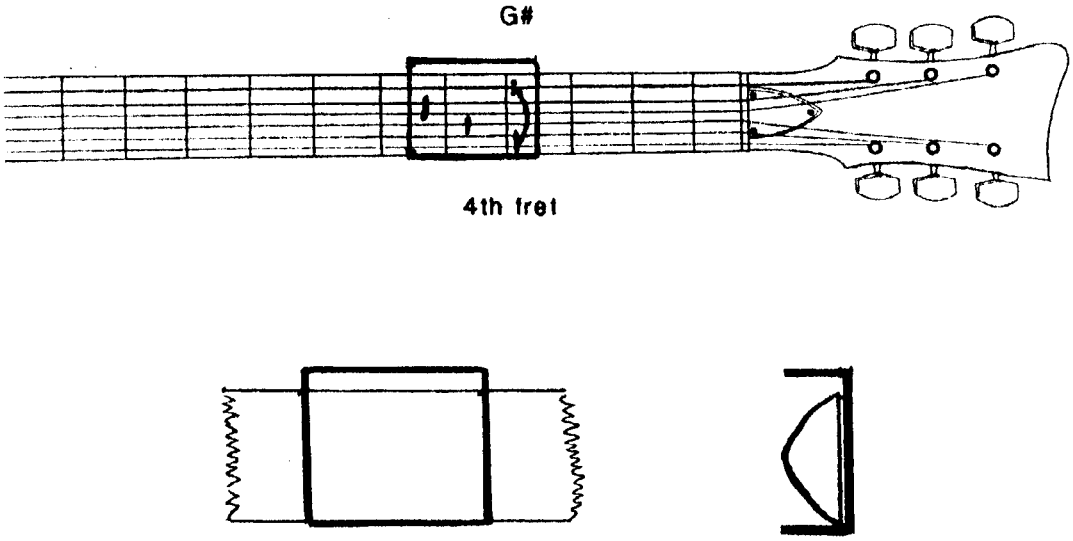

Fig 15A is an example of the proper placement of the "EZ Chord", universal chord device, onto the guitar neck, frets and strings. To form the "G # (sharp)" chord, place the "EZ Chord" front bar pads onto the guitar neck just forward of the fourth fret. While holding the chord in the position above, the lower gripping angle of the chord device must be held firmly lower side of the guitar neck. Pressing the chord with even pressure will ensure that all keypads make equal contact with the strings.

Figure 15B:
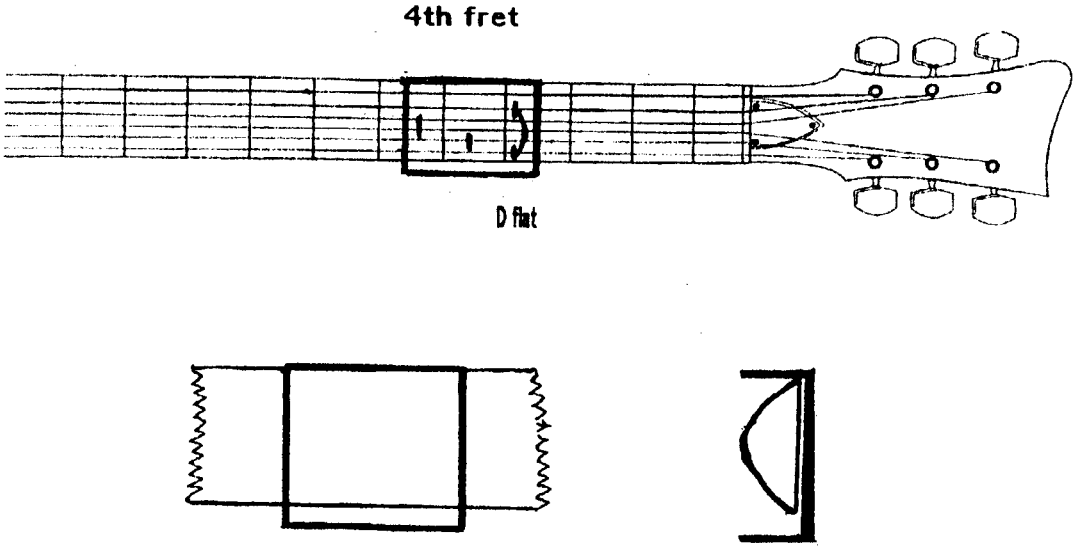

Fig 15B is an example of the proper placement of the "EZ Chord", universal chord device, onto the guitar neck, frets and strings. To form the "D Flat" chord, place the EZ Chord on the bar pads onto the guitar neck just forward of the fourth fret. While holding the chord in the above, the upper gripping angle of the chord device must be held firmly against the upper side of the guitar neck. Pressing the chord with even pressure will ensure that all of the keypad equal contact with the strings.

Figure 16A:
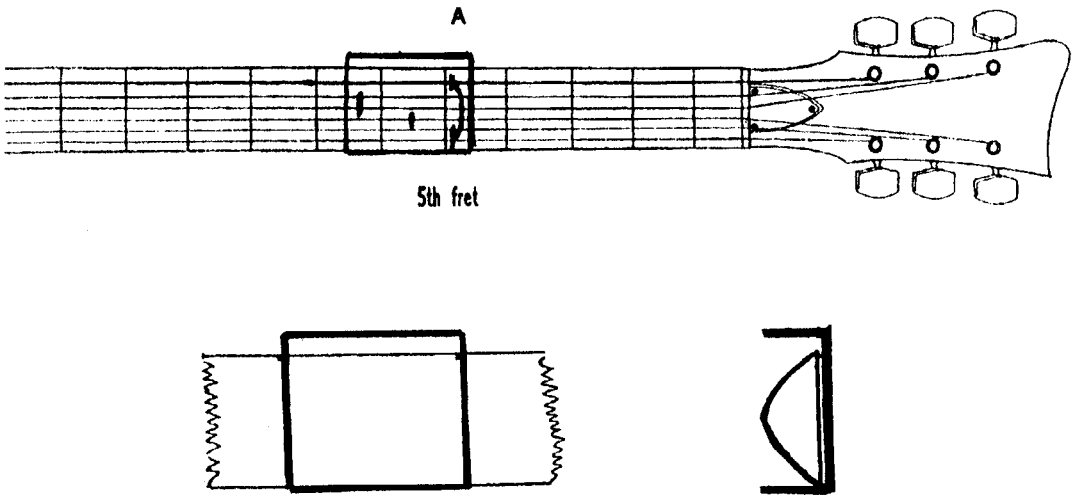

Fig 16A is an example of the proper placement of the "EZ Chord", universal chord device, onto the guitar neck, frets and strings. To form the "A Major" chord, place the EZ Chord front bar pads onto the guitar neck just forward of the fifth fret. While holding the chord in above, the lower gripping angle of the chord device must be held firmly against the low r side of the guitar neck. Pressing the chord with even pressure will ensure that all of the keypad make equal contact with the strings.

Figure 16B:
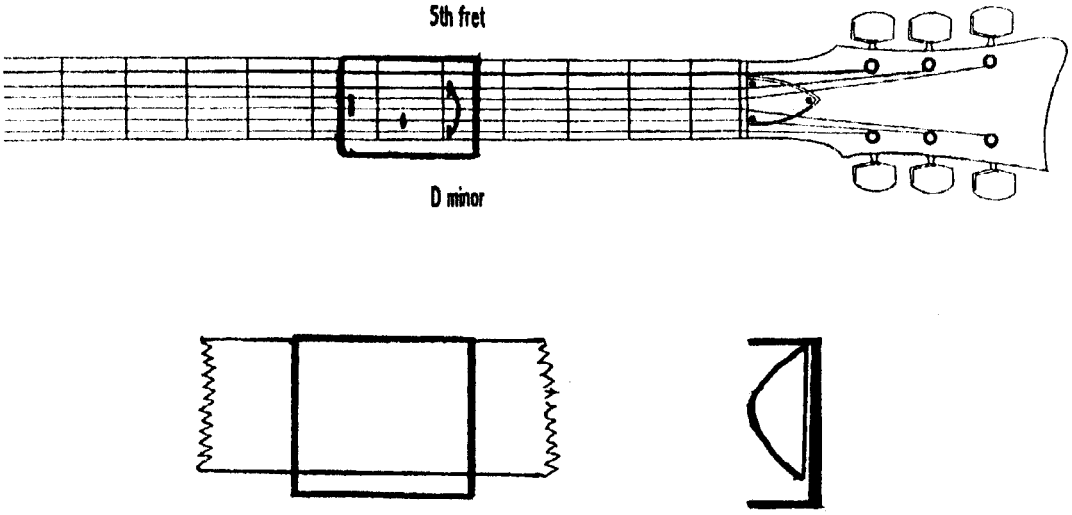

Fig 16B is an example of the proper placement of the "EZ Chord", universal chord device, onto the guitar neck, frets and strings. To form the "D Minor" chord, place the EZ Chord front above, the upper gripping angle of the chord device must be held firmly against the upper side of the guitar neck. Pressing the chord with even pressure will ensure that all of the keypad make equal contact with the strings.

Figure 17A:
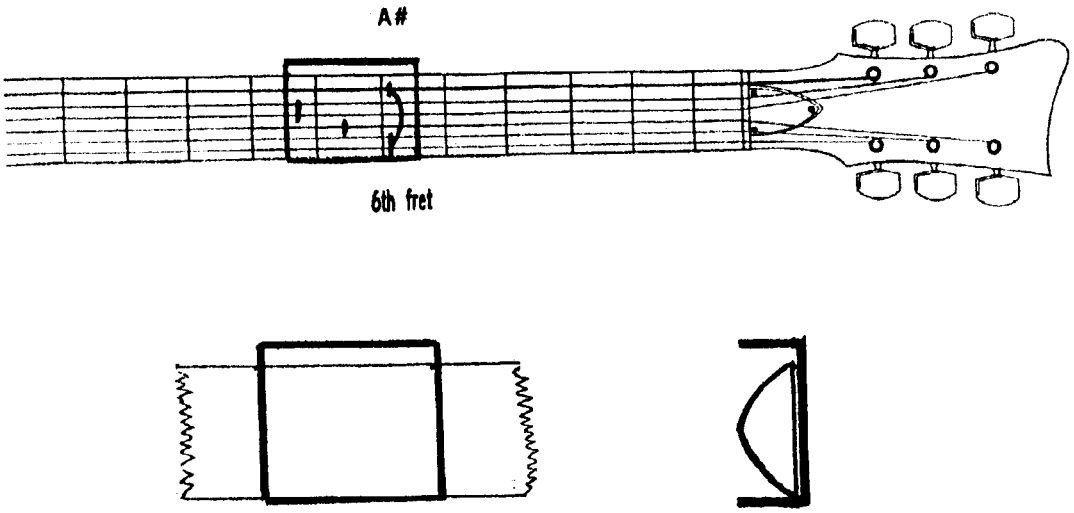

Fig 17 A is an example of the proper placement of the "EZ Chord", universal chord device, onto the guitar neck, frets and strings. To form the "A# (sharp)" chord, place EChord front bar pads onto the guitar neck just forward of the sixth fret. While holding the char in the position above, the lower gripping angle of the chord device must be held firmly against the lower side of the guitar neck. Pressing the chord with even pressure will ensure that all of the eyepads make equal contact with the strings.

Figure 17B:
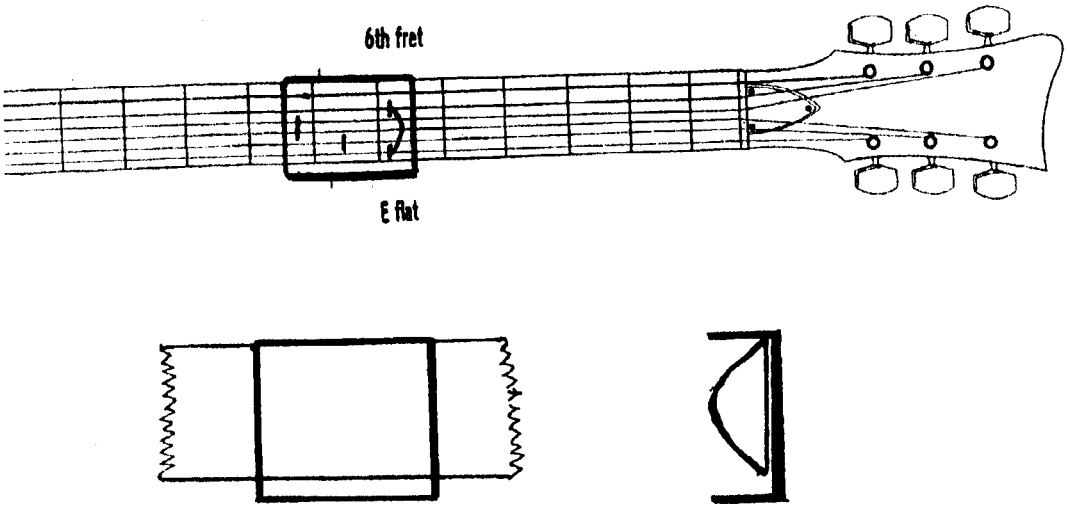

Fig 17B is an example of the proper placement of the "EZ Chord", universal chord device, onto the guitar neck, frets and strings. To form the "E Flat" chord, place the "EZ Chord' front bar pads onto the guitar neck just forward of the sixth fret. While holding the chord in the position above, the upper gripping angle of the chord device must be held firmly against the upper the guitar neck. Pressing the chord with even pressure rill ensure that all of the keypads equal contact with the strings.

Figure 18A:
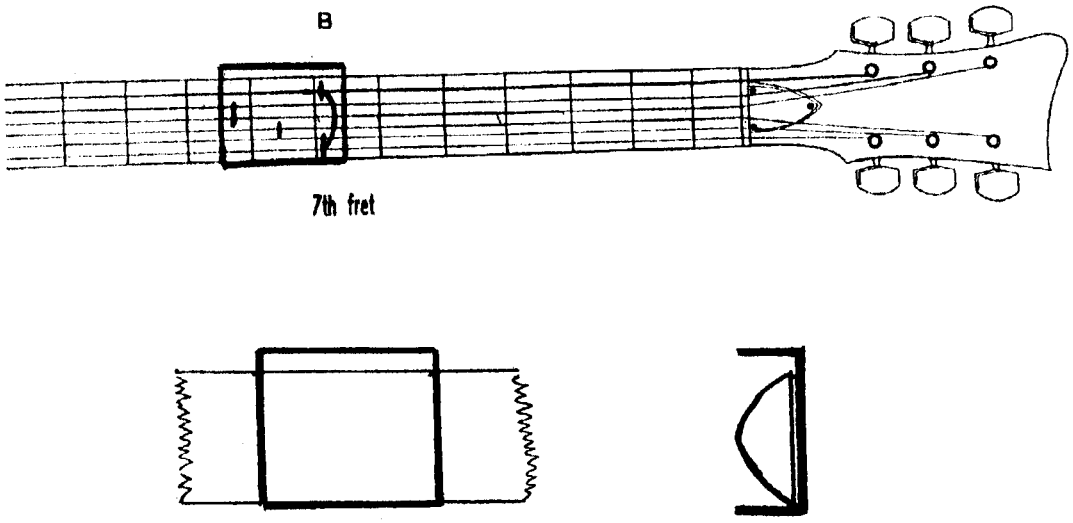
Figure 18B:
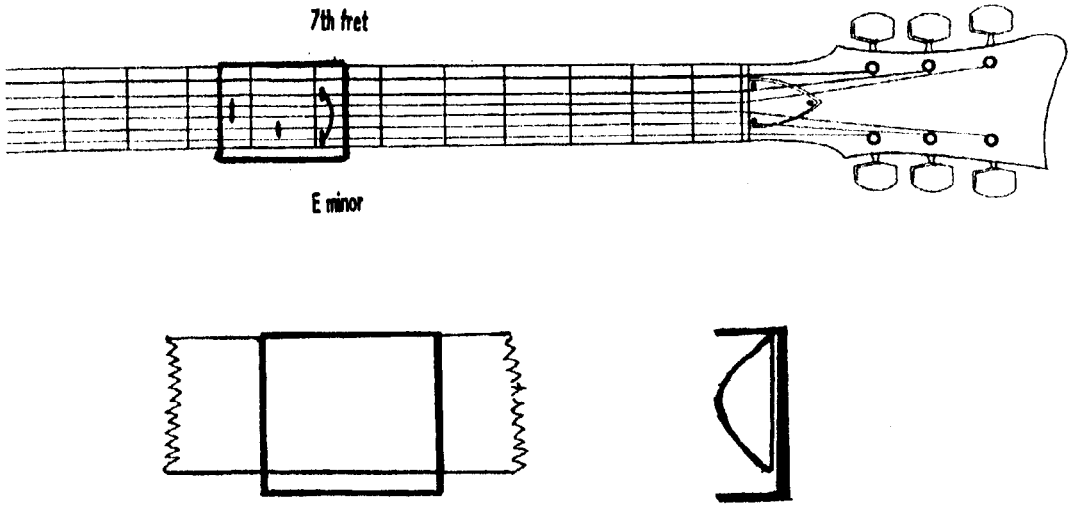

Fig 18 is an example of the proper placement of the "EZ Chord", universal chord device, onto the guitar neck, frets and strings. To form the "B Major" chord, place the EZ Chord front bar pads onto the guitar neck just forward of the seventh fret. While holding the chord· the position above, the lower gripping angle of the chord device must be held firmly against the lower side of the guitar neck. Pressing the chord with even pressure will ensure that all of the make equal contact with the strings Fig 18B is an example of the proper placement of the "EZ Chord", universal chord device, onto the guitar neck, frets and strings. To form the "E Minor" chord, place the EZ Chord front bar pads onto the guitar neck just forward of the seventh fret. While holding the chord position above, the upper gripping angle of the chord device must be held firmly against the upper side of the guitar neck. Pressing the chord with even pressure will ensure that all of the make equal contact with the strings.

Figure 19A:
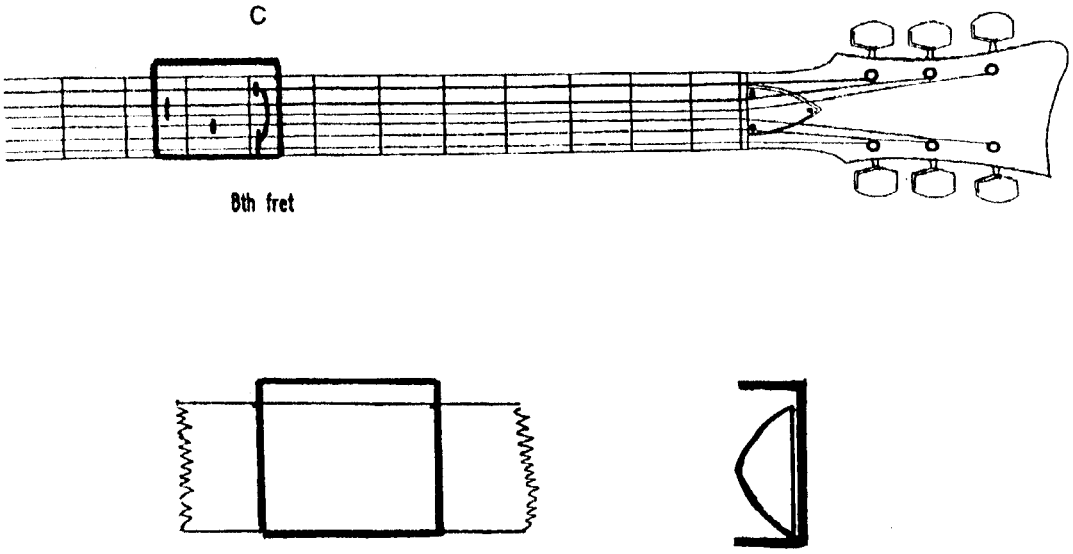

Fig 19 A is an example of the proper placement of the "EZ Chord", universal chord device, onto the guitar neck, frets and strings. To form the "e Major" chord, place the E Chord front bar pads onto the guitar neck just forward of the eighth fret. While holding the chord in the position above, the lower gripping angle'of the chord device must be held firmly against the lower side of the guitar neck. Pressing the chord with even pressure will ensure that all of the keypads make equal contact with the strings.

Figure 19B:
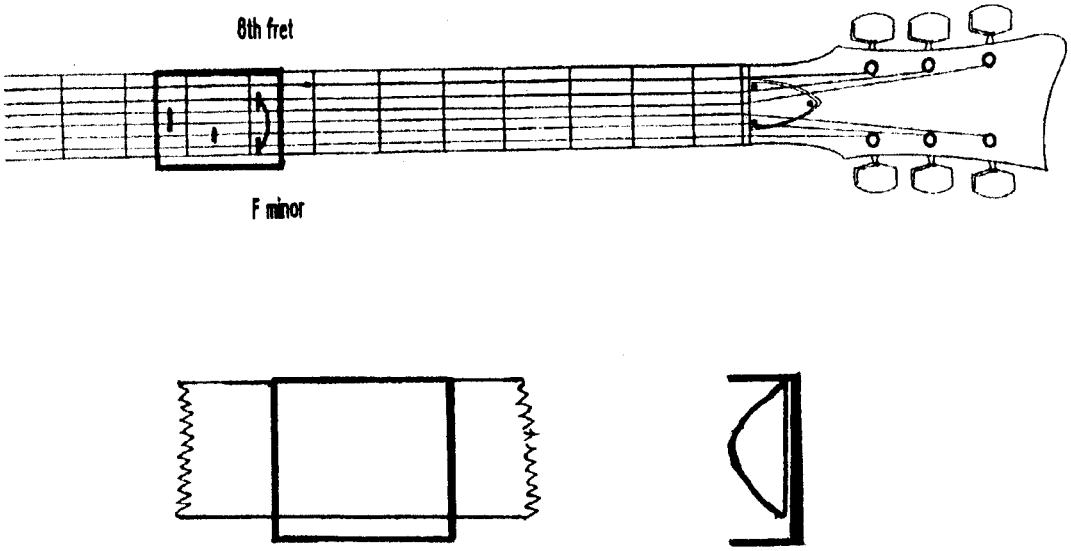

Fig 19B is an example of the proper placement of the "EZ Chord", universal chord device, onto the guitar neck, frets and strings. To form the "F Minor" chord, place the EZ Chord front bar pads onto the guitar neck just forward of the eighth fret. While holding the chord in the position above, the upper gripping angle of the chord device must be held firmly against the upper side of the guitar neck. Pressing the chord with even pressure will ensure that all of the eyepads make equal contact with the strings.

Figure 20A:
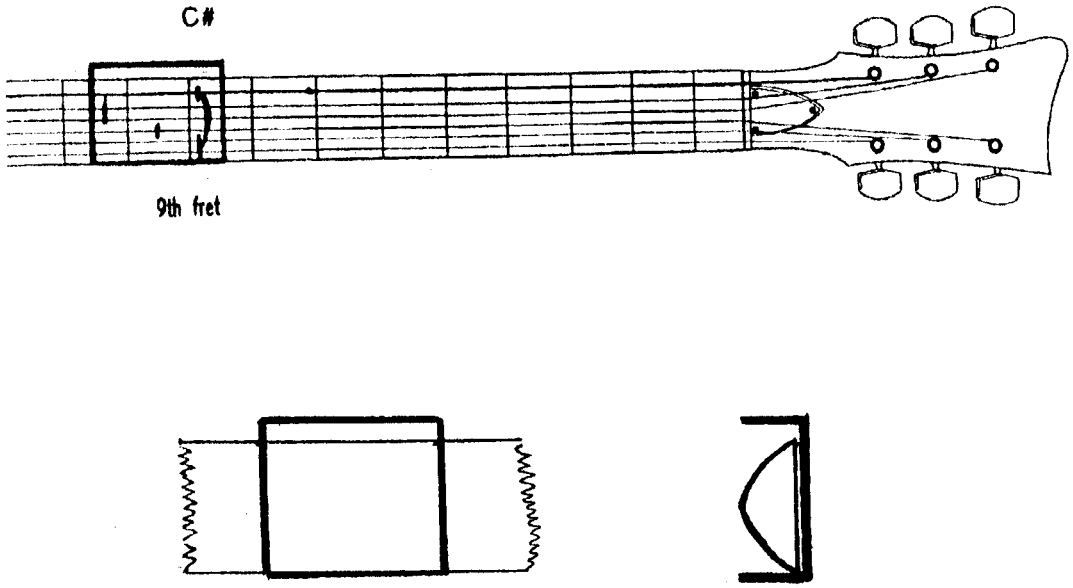

Fig 20A is an example of the proper placement of the "EZ Chord", universal cho d device, onto the guitar neck, frets and strings. To form the "C# (sharp)" chord, place EZ Chord front bar pads mito the guitar neck just forward of the ninth fret. While holding the chord in the p sition above, the lower gripping angle of the chord device must be held finnly against the low side of the guitar neck. Pressing the chord with even pressure will ensure that all of the keypads make equal contact with the strings.

Figure 20B:
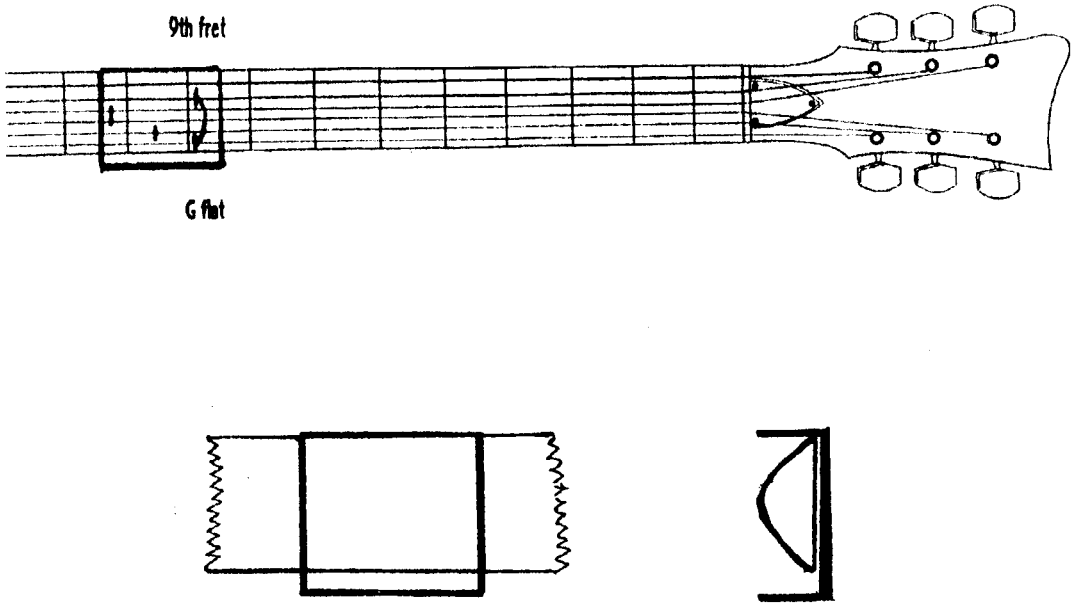

Fig 20B is an example of the proper placement of the "EZ Chord", universal chord device, onto the guitar neck, frets and strings. To form the "G Flat" chord, place the "EZ Chord' front bar pads onto the guitar neck just forward of the ninth fret. While holding the chord in t e position above, the upper gripping angle of the chord device must be held firmly against the upper side of the guitar neck. Pressing the chord with even pressure will ensure that all of the make equal contact with the strings.

Figure 21A:
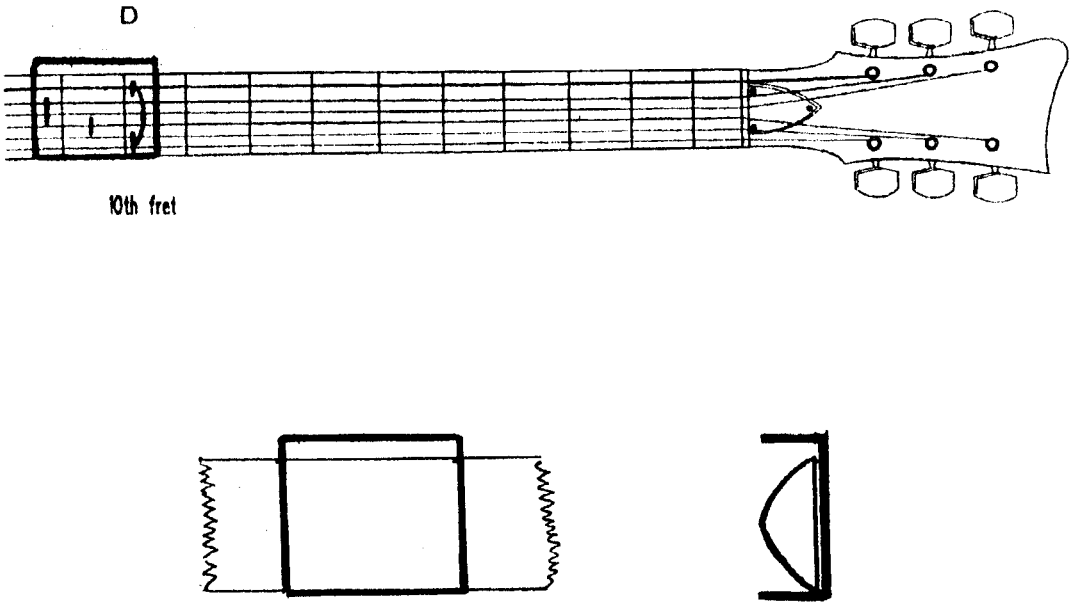

Fig 21A is an example of the proper placement of the "EZ Chord", universal chord device, onto the guitar neck, frets and strings. To form the "D Major" chord, place the EZ Chord bar pads onto the guitar neck just forward of the tenth fret. While holding the chord in e position above, the lower gripping angle of the chord device must be held firmly against side of the guitar neck. Pressing the chord with even pressure will ensure that all of the make equal contact with the strings.

Figure 21B:
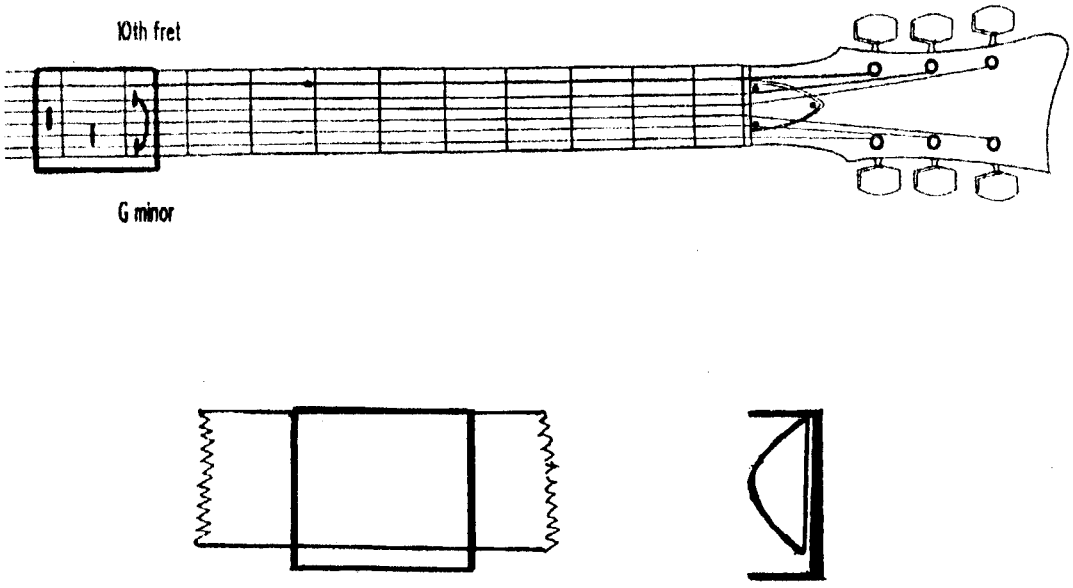

Fig 21B is an example of the proper placement of the "EZ Chord", universal c rd device, onto the guitar neck, frets and strings. To form the "G Minor" chord, place the EZ Chord front bar pads onto the guitar neck just forward of the tenth fret. While holding the chord in e position above, the upper gripping angle of the chord device must be held firmly against the upper side of the guitar neck. Pressing the chord with even pressure will ensure that all of the keypads make equal contact with the strings.

Figure 22A:
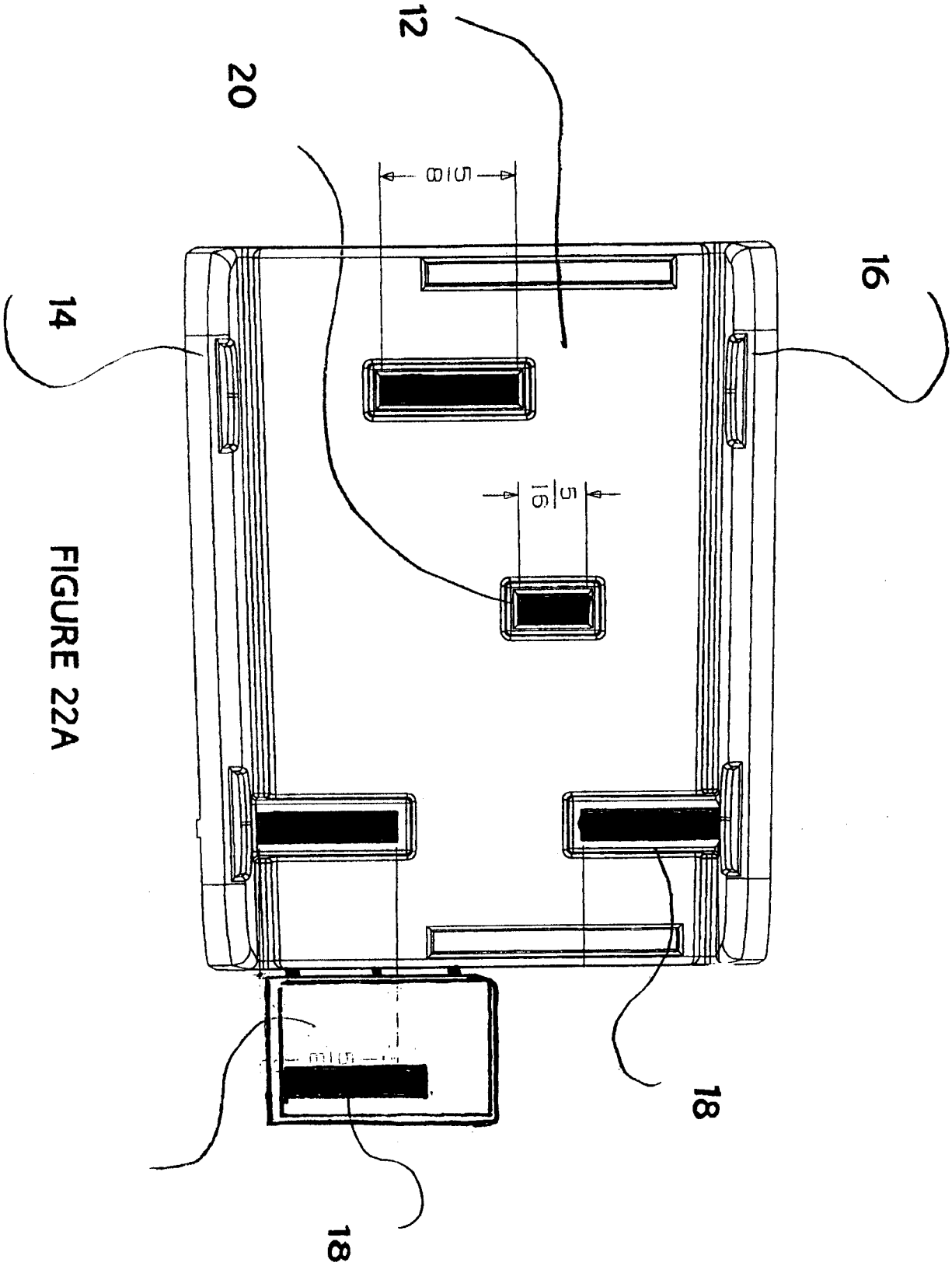

Fig 22A is a perspective geometric inside back view of the "EZ Chord", univer chord device and power chord attachment. The power chord attachment is operated with the finger for strumming blues type and other rhythm music.

--.

(12) United States Patent
Davis

(10) Patent No.: US 7,468,478 B2
(45) Date of Patent: Dec. 23, 2008

(54) GUITAR PLAYING ASSIST APPARATUS

(76) Inventor: Barry Mark Davis, 8142 E. Lake Cypress Dr., Perkinston, MS (US) 39573

( * ) Notice: Subject to any disclaimer, the term of this patent is extended or adjusted under 35 U.S.C. 154(b) by 376 days.

(21) Appl. No.: 10/916,575

(22) Filed: Aug. 12, 2004

(65) Prior Publication Data

US 2005/0145089 A1 Jul. 7, 2005

Related U.S. Application Data

(60) Provisional application No. 60/532,740, filed on Dec. 29, 2003.

(51) Int. Cl.
*G10D 3/00* (2006.01)

(52) U.S. Cl. ..... 84/290

(58) Field of Classification Search ..... 84/485 R, 84/485 SR, 478, 477 R, 484
See application file for complete search history.

(56) References Cited

U.S. PATENT DOCUMENTS 1,346,458 A * 7/1920 Lewis ..... 84/285
4,331,059 A * 5/1982 Marabotto ..... 84/317
4,566,365 A * 1/1986 Huston, Jr. ..... 84/317
6,087,568 A * 7/2000 Seal ..... 84/193
6,891,095 B2 * 5/2005 Charters ..... 84/320
2006/0000342 A1 * 1/2006 Haney ..... 84/471 SR

* cited by examiner

*Primary Examiner*—Kimberly Lockett
(74) *Attorney, Agent, or Firm*—John D. Gugliotta

(57) ABSTRACT

A thin flat body of clear plastic with a key pad (20) on the inside back base (12), and a chord scale (22) on the outside front of the base (10). The chord scale is fitted with braille nodules (24) for guiding the proper placement of the fingers on the EZ chord. On the bottom or lower side of the base (10) (12) is a gripping angle (14) for the learning chord device. On the top or upper side, and bottom or lower side of the base (10) (12) are gripping angles (14) (16) for the universal chord device. One EZ chord is a device that when manipulated by a human hand, or an artificial hand, is pressed and positioned onto the guitar neck, fret and strings to form and sound guitar chords and/or notes. The EZ chord devices can be used by mentally, physically, or visually handicapped people as well as non-handicapped people, to play and/or learn to play the guitar.

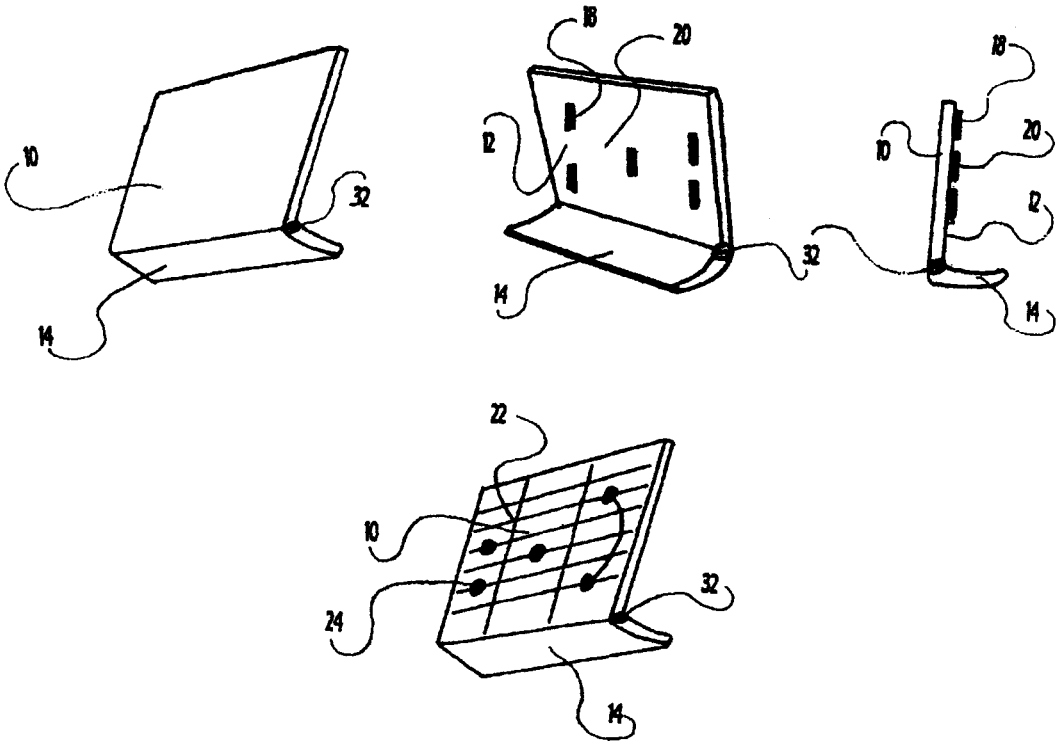

24 Claims, 19 Drawing Sheets